US008117713B2

(12) United States Patent
Kasper et al.

(10) Patent No.: US 8,117,713 B2
(45) Date of Patent: Feb. 21, 2012

(54) VACUUM CLEANER WITH TWO STAGE FILTRATION

(75) Inventors: Gary A. Kasper, Grand Rapids, MI (US); Allen W. Scott, Fort Wayne, IN (US); Jose Carlito Santiago, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 1248 days.

(21) Appl. No.: 11/534,444

(22) Filed: Sep. 22, 2006

(65) Prior Publication Data

US 2007/0067945 A1 Mar. 29, 2007

Related U.S. Application Data

(60) Provisional application No. 60/596,446, filed on Sep. 23, 2005.

(51) Int. Cl.
*A47L 9/10* (2006.01)

(52) U.S. Cl. ..... 15/353; 15/320; 15/328; 15/347; 15/352

(58) Field of Classification Search ..... 15/353, 15/328, 352, 347, 320
See application file for complete search history.

(56) References Cited

U.S. PATENT DOCUMENTS

| | | | | |
|---|---|---|---|---|
| 1,395,500 | A | | 11/1921 | Kirby |
| 1,608,026 | A | | 11/1926 | Keefer |
| 3,775,951 | A | | 12/1973 | Eichholz et al. |
| 3,896,520 | A | | 7/1975 | Williams |
| 4,216,563 | A | | 8/1980 | Cyphert |
| 4,251,241 | A | * | 2/1981 | Bothun ..... 96/317 |
| 4,287,636 | A | | 9/1981 | Brazier |
| 4,571,772 | A | | 2/1986 | Dyson |
| 5,216,778 | A | | 6/1993 | Suzuki et al. |
| 5,287,590 | A | | 2/1994 | Yonkers et al. |
| 5,544,385 | A | | 8/1996 | Jailor et al. |
| 5,815,881 | A | | 10/1998 | Sjogreen |
| 5,943,732 | A | * | 8/1999 | Bosyj et al. ..... 15/328 |
| 5,960,514 | A | | 10/1999 | Miller et al. |
| 6,070,289 | A | | 6/2000 | Lee et al. |
| 2004/0055105 | A1 | | 3/2004 | Park et al. |

FOREIGN PATENT DOCUMENTS

| | | | |
|---|---|---|---|
| DE | 2824033 | A1 | 12/1979 |
| DE | 3007654 | A1 | 9/1981 |
| EP | 0362895 | A1 | 4/1990 |
| EP | 0386367 | A | 9/1990 |
| FR | 2096807 | A1 | 3/1972 |
| GB | 875148 | A | 8/1961 |
| GB | 1248874 | A | 10/1971 |
| GB | 2160090 | A | 12/1985 |
| GB | 2363705 | A | 1/2002 |
| JP | 10080382 | A | 3/1998 |
| WO | 2005039375 | A1 | 5/2005 |

* cited by examiner

*Primary Examiner* — Robert Scruggs
(74) *Attorney, Agent, or Firm* — McGarry Bair PC

(57) ABSTRACT

A canister vacuum cleaner comprises a base, a recovery tank, and a clean solution tank. The vacuum cleaner can be used for dry vacuuming, wet vacuuming, and can distribute cleaning solution to a floor surface and has means for a fluid distribution system and a recovery system. The clean solution tank can be filled with a cleaning solution for distribution to a floor surface and the recovery tank is used for collecting dry or liquid matter recovered from vacuuming.

14 Claims, 24 Drawing Sheets

VACUUM CLEANER WITH TWO STAGE FILTRATION

CROSS-REFERENCE TO RELATED APPLICATION

This application claims the benefit of U.S. provisional application Ser. No. 60/596,446, filed Sep. 23, 2005, which is incorporated herein in its entirety.

BACKGROUND OF THE INVENTION

1. Field of the Invention

This invention relates to vacuum cleaners. In one of its aspects, the invention relates to a vacuum cleaner having two stages of filtration. In another of its aspects, the invention relates to an extraction cleaner that has two stages of filtration. In yet another of its aspects, the invention relates to a multiple use vacuum cleaner that is adapted for dry vacuuming, extraction, and bare floor cleaning.

2. Description of the Related Art

Vacuum cleaners are well-known household cleaning devices that are used to clean dirt and debris from rugs and carpets. Vacuum cleaners commonly use a motor-driven suction fan to draw dirt-laden air into the unit, filter the air through some filtering means and exhaust the relatively clean air back into the room. One type of filtering means is a filter bag, wherein dirt-laden air is drawn into a porous bag which traps dirt and allows relatively clean air to exit through the walls of the bag to the environment as disclosed in U.S. Pat. No. 5,544,385 to Jailor et al. However, fine dirt particles can escape through the walls of the bag, thus recontaminating a room. Also, bags must be changed regularly when they are full, which is a time-consuming operation and requires a user to have a supply of new filter bags at hand, which adds additional expense to a vacuum cleaner. Changing filter bags is often a messy operation during which some of the collected dirt can become reentrained in the environment of a room.

An alternative to vacuum cleaners having filter bags as a filtering means are bagless vacuum cleaners which use cyclonic separators to separate dirt from the air using centrifugal force as disclosed in U.S. Pat. No. 4,571,772 to Dyson. Dirt-laden air is introduced into a cyclone separator, usually through a tangential opening near the top of the separator, and flows through the separator in a well-established cyclonic pattern. Dirt is separated from the air and is thrown outwardly against the walls of the separator where it falls down into a collection chamber. Relatively clean air then exits the separator and is exhausted to the environment. As with a bagged vacuum cleaner, this exhausted air may still contain fine dirt particles that were not filtered out in the cyclonic separator. And while the collection chamber for a cyclonic vacuum cleaner can be removed from the vacuum cleaner and emptied with relative ease compared to the changing of a filter bag, the dumping operation can also allow dirt particles to be reentrained in the air.

A third type of filtering means is the use of a water bath to remove dirt from air flowing through a vacuum cleaner as disclosed in U.S. Pat. No. 4,251,241 to Bothun. Dirt-laden air that is drawn in by the suction fan is ported through an air inlet such that it is directed through a reservoir of water. Heavier dirt particles are captured by the water while the filtered air exits the water bath and is exhausted to the environment. The reservoir of water may be a detachable chamber to facilitate disposal of the dirty water after vacuum cleaning. Emptying the reservoir of dirty water is more hygienic in comparison to changing filter bags or emptying a collection chamber filled with dry dirt, since the dirty water can be poured into a sink or drain without any particle reentrainment into the environment as is observed when pouring out dry dirt.

Even with regular vacuum cleaning, carpets often require more intense cleaning to remove stains or dirt that is deeply ingrained into the carpet pile. One way of deep cleaning a carpet is referred to as wet extraction and can be accomplished distributing a cleaning solution over the carpet and removing the spent cleaning solution by vacuum suction. Many homeowners choose to have this done professionally since they do not have the necessary equipment for deep cleaning a carpet or do not want to purchase a wet extraction machine that will only be used a few times a year. Some vacuum cleaners can be converted into a wet extraction cleaner to combine the functions of dry vacuuming and carpet deep cleaning as disclosed in U.S. Pat. No. 5,287,590 to Yonkers et al. These devices often have many complicated parts that must be interchanged in order to perform each function.

Many homes include bare floors such as linoleum, tile, or hardwood in addition to carpeted surfaces. Most homeowners have vacuum cleaners, whether bagged, bagless, or water-filtered, that are adapted for carpeted surfaces and may damage bare floors, thus additional cleaning devices are required. Bare floors commonly require multiple implements in order to achieve a thoroughly clean surface. Usually, a broom and dustpan are first used to gather and remove loose, dry particles from the floor. However, it is almost impossible to transfer all the dirt onto a dustpan and consequently, some dirt remains on the floor. After sweeping, a cleaning liquid is applied to the floor, most commonly by a sponge or rag mop. A mop is a very efficient cleaning means but when it requires more cleaning solution, the mop must be returned to a bucket to absorb additional cleaning solution to be reapplied to the floor surface. The repeated dipping of the mop into the bucket quickly dirties and cools the cleaning solution rendering the cleaning process less effective. After mopping, some cleaning solution remains on the floor surface to air dry, and the duration of time required for the bare surface to completely dry depends on the amount of residual solution on the floor and the relative humidity in the room. During the drying period, foot traffic must be avoided since dirt and other debris will easily adhere to the damp floor surface.

Some household cleaning devices have been developed that combine carpet dry vacuuming and deep cleaning with bare floor cleaning to eliminate the need for multiple cleaning devices for different types of cleaning. These cleaning devices are referred to as wet/dry vacuum cleaners or three-in-one cleaners. Many of these combined cleaners require disassembling the unit or changing certain parts such as filter or collection means to switch between cleaning types. For example, U.S. Pat. No. 4,287,636 to Brazier discloses a vacuum cleaner that can be used for both dry vacuuming and wet extraction. However, a filter unit for dry vacuuming must be exchanged for a reservoir unit when a user desires to use the vacuum cleaner for extraction.

The present invention solves the aforementioned problems by providing a single cleaning machine with a water bath filter in combination with a cyclone separator that can be used on both carpet and bare floors for both dry and wet pickup.

SUMMARY OF THE INVENTION

According to one aspect of the invention, a combination wet-dry vacuum cleaner comprises a recovery tank adapted for both wet and dry cleaning that is fluidly connected to a suction nozzle, the recovery tank having an air-liquid separator, a cyclone separator that is fluidly connected to an outlet in the recovery tank, and a suction source that is fluidly connected to the suction nozzle through the recovery tank and the cyclone separator to draw dry dirt-laden air and liquid-laden air from the suction nozzle through the recovery tank and the cyclone separator. During dry cleaning, the dry dirt-laden air is filtered with a water bath. During wet cleaning, the liquid-laden air is separated in the air-liquid separator in the recovery tank and the cyclone separator. Any liquid remaining in the air is recovered before the air enters the suction source.

The vacuum cleaner can further comprise a diverter valve between the suction nozzle and the recovery tank for directing the liquid-laden air to the air-liquid separator and for alternatively directing the dry dirt-laden air to the recovery tank.

The recovery tank can further comprise a conduit to pass dry dirt-laden air into a lower portion of the recovery tank as it enters the recovery tank so that the dry dirt-laden air can be filtered in the water bath in the recovery tank.

The recovery tank can further comprise a lower portion and an upper portion, wherein the upper portion is selectively removable from the lower portion and the upper and lower portions are separated by seals, and wherein the upper and lower portions are shaped so that the seals are above the maximum fill level of water in the recovery tank.

In accordance with another embodiment of the invention, a combination wet-dry vacuum cleaner comprises a recovery tank that is connected to a suction nozzle, a first air-liquid separator in the recovery tank for separating air from liquid from the suction nozzle when an air-liquid mixture enters the recovery tank; a second separator that is connected to an outlet in the recovery tank to remove liquid from air before it passes from the recovery tank; and a suction source that is connected to the suction nozzle through the recovery tank and the second separator to draw dry dirt-laden air and liquid-laden air from the suction nozzle through the recovery tank and the cyclone separator. The recovery tank is thus adapted for both wet and dry cleaning, the dry dirt-laden air is filtered with a water bath for dry cleaning and the liquid-laden air is separated in the air-liquid separator in the recovery tank and the second separator for wet cleaning. Thus, any remaining liquid in the air is recovered before entering the suction source.

In one embodiment, a diverter valve is positioned between the suction nozzle and the recovery tank for directing the liquid-laden air to the air-liquid separator and for directing the dry dirt-laden air into a water bath in the recovery tank. In a preferred embodiment of the invention, the recovery tank further comprises a conduit to pass dry dirt-laden air into a lower portion of the recovery tank as it enters the recovery tank so that the dry dirt-laden air can be filtered in the water bath in the recovery tank.

In accordance with still another embodiment of the invention, a combination wet-dry vacuum cleaner comprises a recovery tank that is connected to a suction nozzle, an air-liquid separator in the recovery tank for separating air from liquid from the suction nozzle, a diverter valve between the suction nozzle and the recovery tank for directing the liquid-laden air to the air-liquid separator and alternately for directing the dry dirt-laden air into a water bath in the recovery tank and a suction source that is connected to the suction nozzle through the recovery tank to draw dry dirt-laden air and liquid-laden air from the suction nozzle through the recovery tank and the cyclone separator. The recovery tank is thus adapted for both wet and dry cleaning, wherein the dry dirt-laden air is filtered with a water bath for dry cleaning and the liquid-laden air is separated in the air-liquid separator in the recovery tank.

According to another embodiment of the invention, a dry vacuuming nozzle comprises a nozzle housing, a brush rotatably mounted in the housing and at least a pair of wheels mounted in the housing wherein the wheels are connected to the brush to drive the brush about an axis of rotation when the wheels are rotated.

According to yet another embodiment of the invention, a canister vacuum cleaner having a housing and a glide mounted to an under surface of the housing is provided, wherein the glide comprises at least a partial spherical surface that is adapted to glide over a carpet surface to distribute the load over the carpet for easy movement. The glide can further be mounted to the housing for rotation about a vertical axis.

The canister vacuum cleaner can further comprise at least one wheel mounted to the glide and adapted to contact a bare floor surface when the canister moves along a bare floor.

DESCRIPTION OF THE PREFERRED EMBODIMENT

Figure 1:
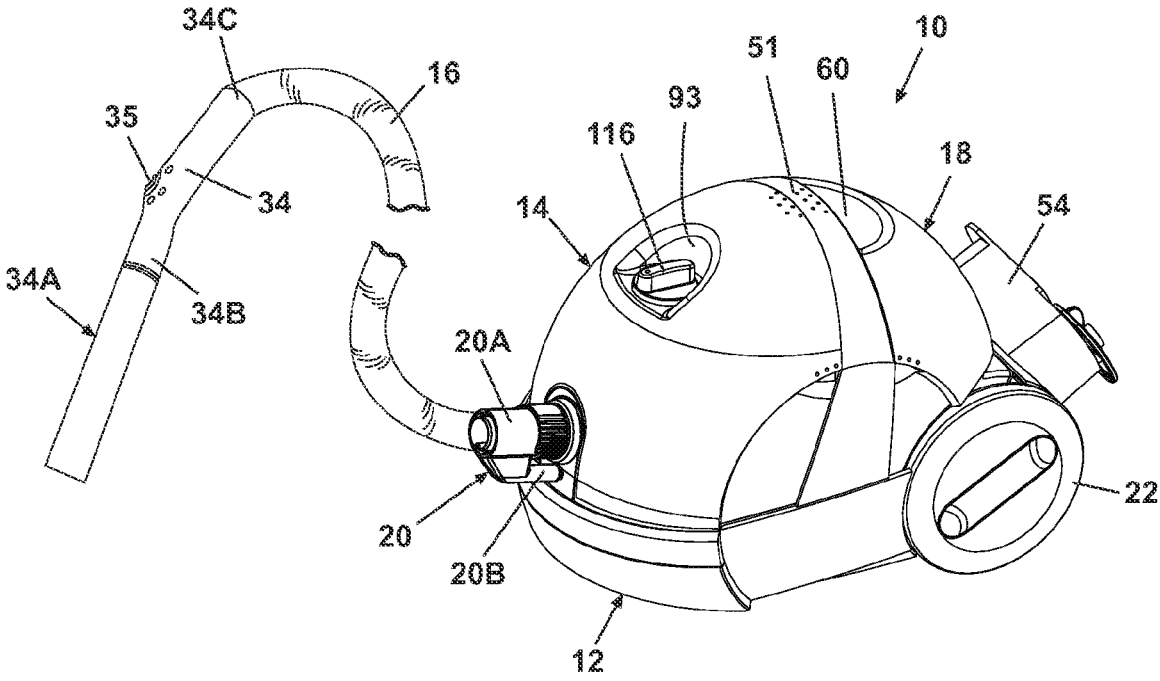
FIG. 1 is a perspective view of a canister vacuum cleaner according to the invention.
Figure 2:
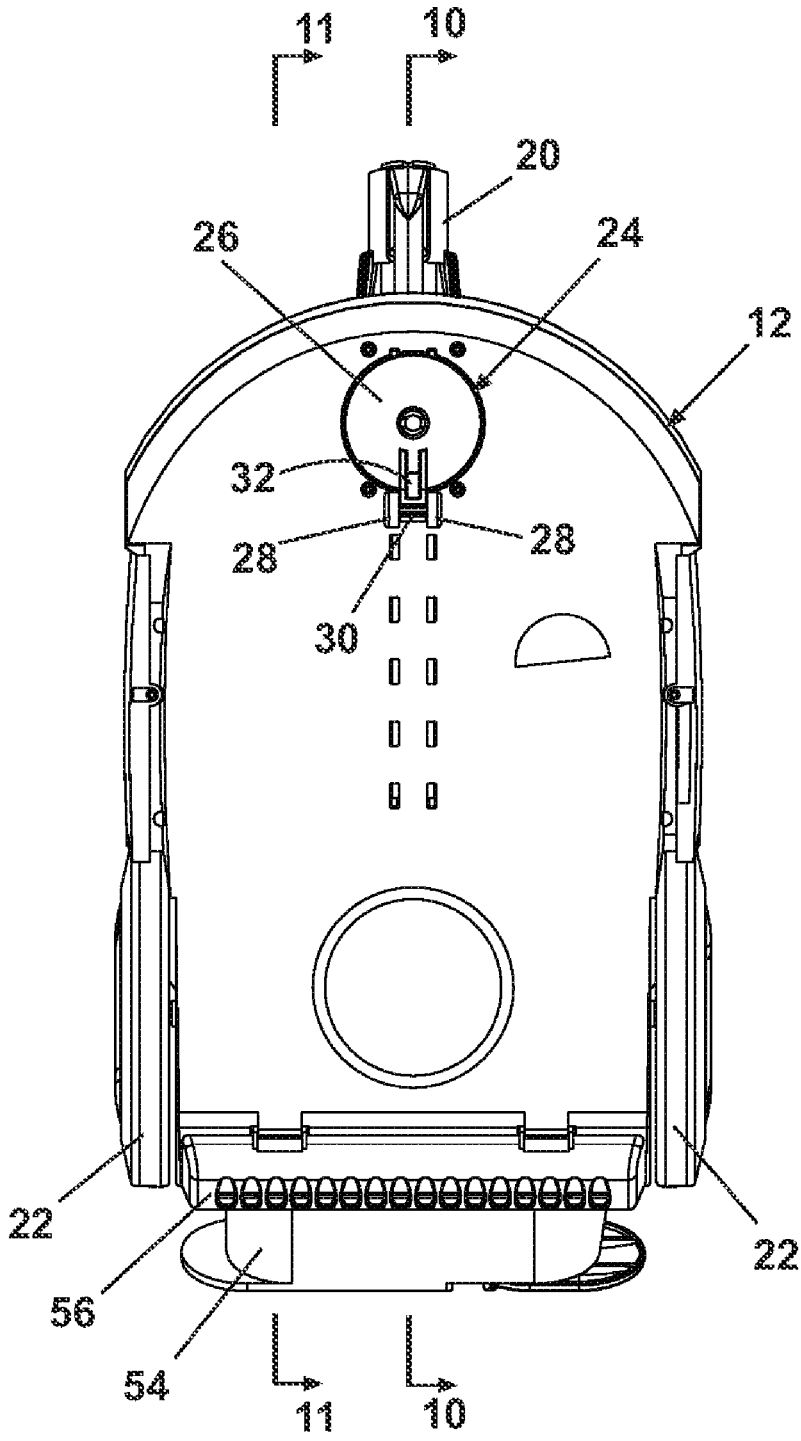
FIG. 2 is a bottom view of the vacuum cleaner shown in FIG. 1.

Referring now to the drawings and in particular to FIGS. 1 and 2, a canister vacuum cleaner 10 is described comprising a base 12, a recovery tank 14, a clean solution tank 18, and a hose interface 20. The vacuum cleaner 10 is mobile, with a pair of rear wheels 22, and a front wheel assembly 24. The front wheel assembly 24 consists of a glide ball 26 that is partially recessed into the base 12 and two bogey wheels 28 that rotate on an axle 30 mounted on a projection 32 extending from the glide ball 26. On a carpeted surface, the glide ball 26 glides over the carpet pile for easy maneuvering. On a bare floor, the bogey wheels 28 engage the bare floor to maneuver the vacuum cleaner 10.

The hose interface comprises a suction conduit 20*a* and a clean solution conduit 20*b*. The clean solution conduit 20*b* is in fluid communication with the clean solution tank 18 to provide a path for transporting cleaning solution from the solution tank 18 to a commonly known fluid distributor (not shown) that distributes cleaning solution to a surface to be cleaned. A suitable fluid distributor is more fully described in U.S. Pat. No. 5,813,087 to Huffman which is incorporated herein by reference in its entirety.

A hose 16 is fluidly connected at one end to the hose interface 20 by a ¼ turn bayonet fastener and at the other end to a hollow grip 34. The hose 16 comprises a suction conduit 16*a* in fluid communication with a wand 34*a* and the suction conduit 20*a* of the hose interface 20 to provide a path for dirt-laden air or water to move from a floor nozzle 284, 286, or 288 to the recovery tank 14, as will be described below. The hose 16 further comprises a clean solution conduit 16*b* in fluid communication with the clean solution conduit 20*b* of the hose interface. Optionally, the hose 16 and hose interface 20 can be swivelably connected to increase the ease of moving the canister vacuum cleaner 10 around a room.

The grip 34 comprises a hose receiving end 34*c* in fluid communication with the hose 16 and a wand receiving end 34*b* in fluid communication with a floor nozzle (dry vacuuming nozzle 284, wet extraction nozzle 286) in a manner that will be discussed in more detail below. A hollow wand 34*a* is in fluid communication with and selectively detachable from the grip 34. The grip 34 has a trigger assembly 35 that controls the distribution of cleaning solution to the surface to be cleaned.

Figure 3:
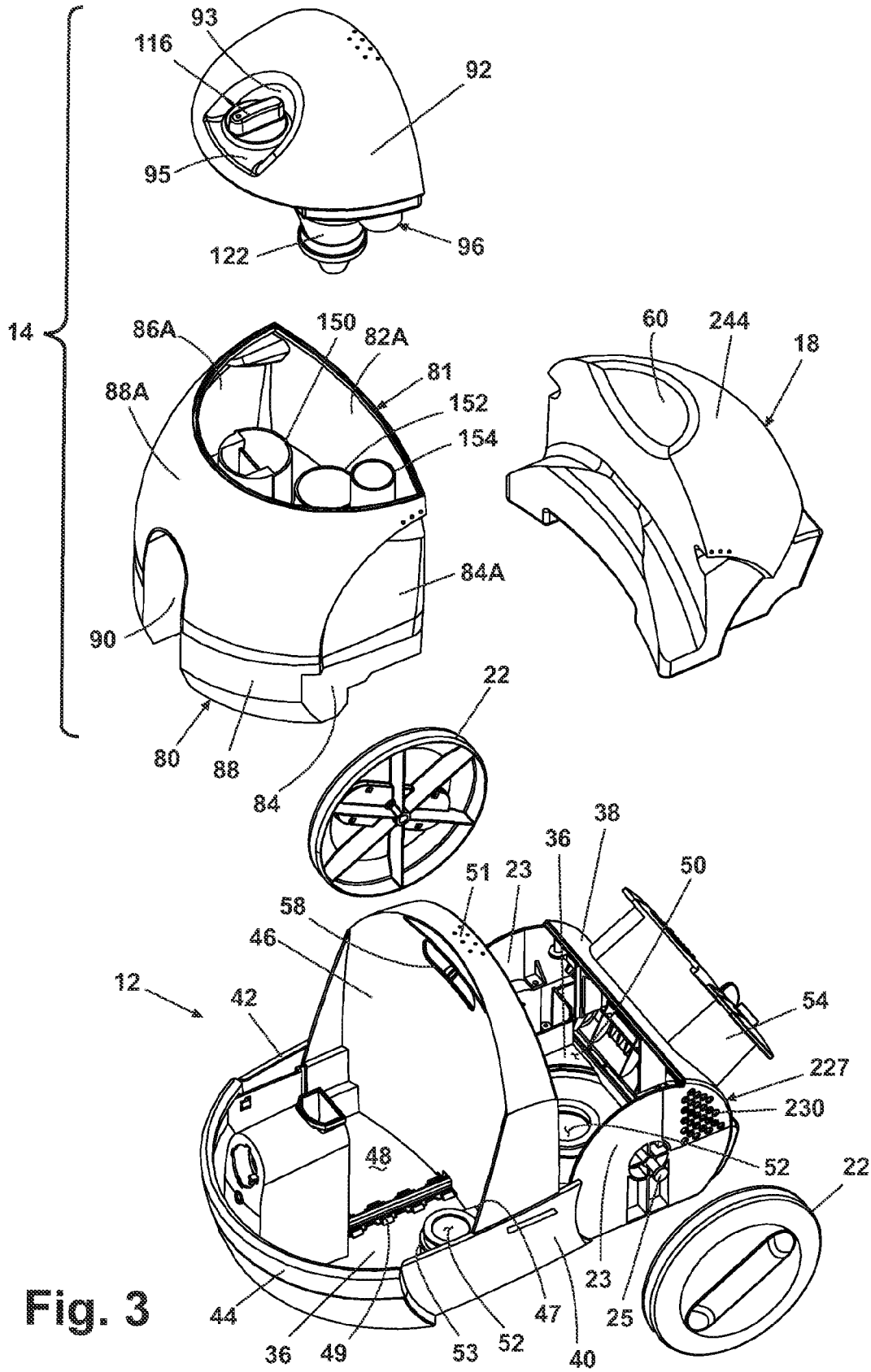
FIG. 3 is an exploded perspective view of the vacuum cleaner shown in FIG. 1.
Figure 4A:
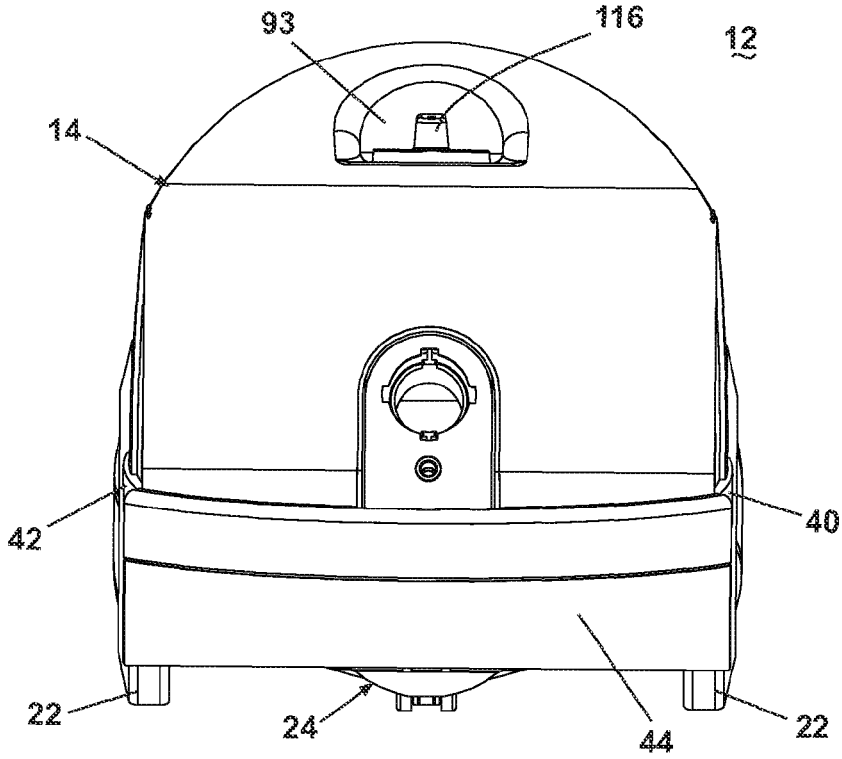
FIG. 4*a* is a front view of the base of the vacuum cleaner shown in FIG. 3.
Figure 4B:
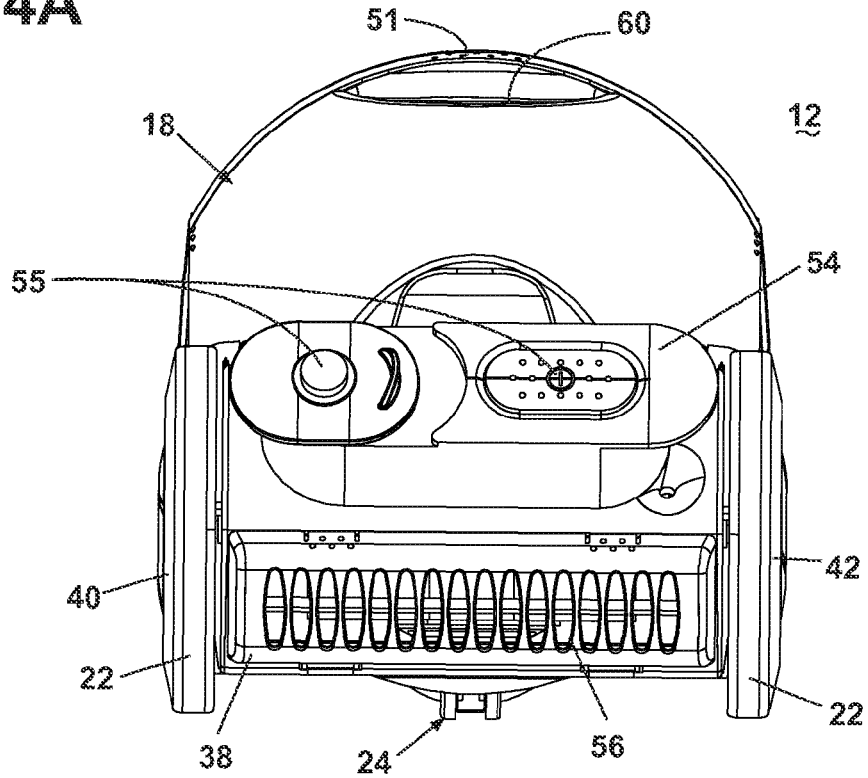
FIG. 4*b* is a rear view of the base of the vacuum cleaner shown in FIG. 3.

Referring to FIG. 3-4B, the base 12 comprises a bottom surface 36, a back wall 38, two opposing side walls 40, 42 and a curved front wall 44. The wheels 22 are rotatably attached to the base 12 by axels 25 connected to a wheel housing 23 formed on the sides 40, 42 of the base 12. A partition 46 extends vertically from the bottom surface 36 and horizontally from side wall 40 to side wall 42 and has an aperture 47 at a lower end. A first recess 48 is defined by the bottom surface 36, the front wall 44, the side walls 40, 42 and the partition 46. A tube track 49 runs from the partition 46 across the bottom surface 36 of the first recess 48. The tube track 49 receives a tube 260 that conveys cleaning solution from the clean solution tank 18 to the hose interface 20. A second recess 50 is defined by the bottom surface 36, the partition 46, the side walls 40, 42 and the back wall 38. A third recess 52 is defined by a wall 53 and extends from the first recess 48, through the aperture 47, and into the second recess 50. The partition 46 further has a flat upper surface that functions as a handle 51 with an opening 58. A corresponding recess 60 is formed in the clean solution tank 18 so that the user can carry that vacuum cleaner 10 when the tanks 14, 18 are in place on the base 12. A cord wrap 54 is provided on the back wall 38 for wrapping an electrical cord (not shown) for storage. Commonly known electrical on/off switches 55 are located on the cord wrap 54 and can be actuated by a hand or foot of the user for controlling the actuation of a suction source and a fluid distribution mechanism. A removable exhaust grill 56 is located beneath the cord wrap 52 on the back wall 38.

Figure 5:
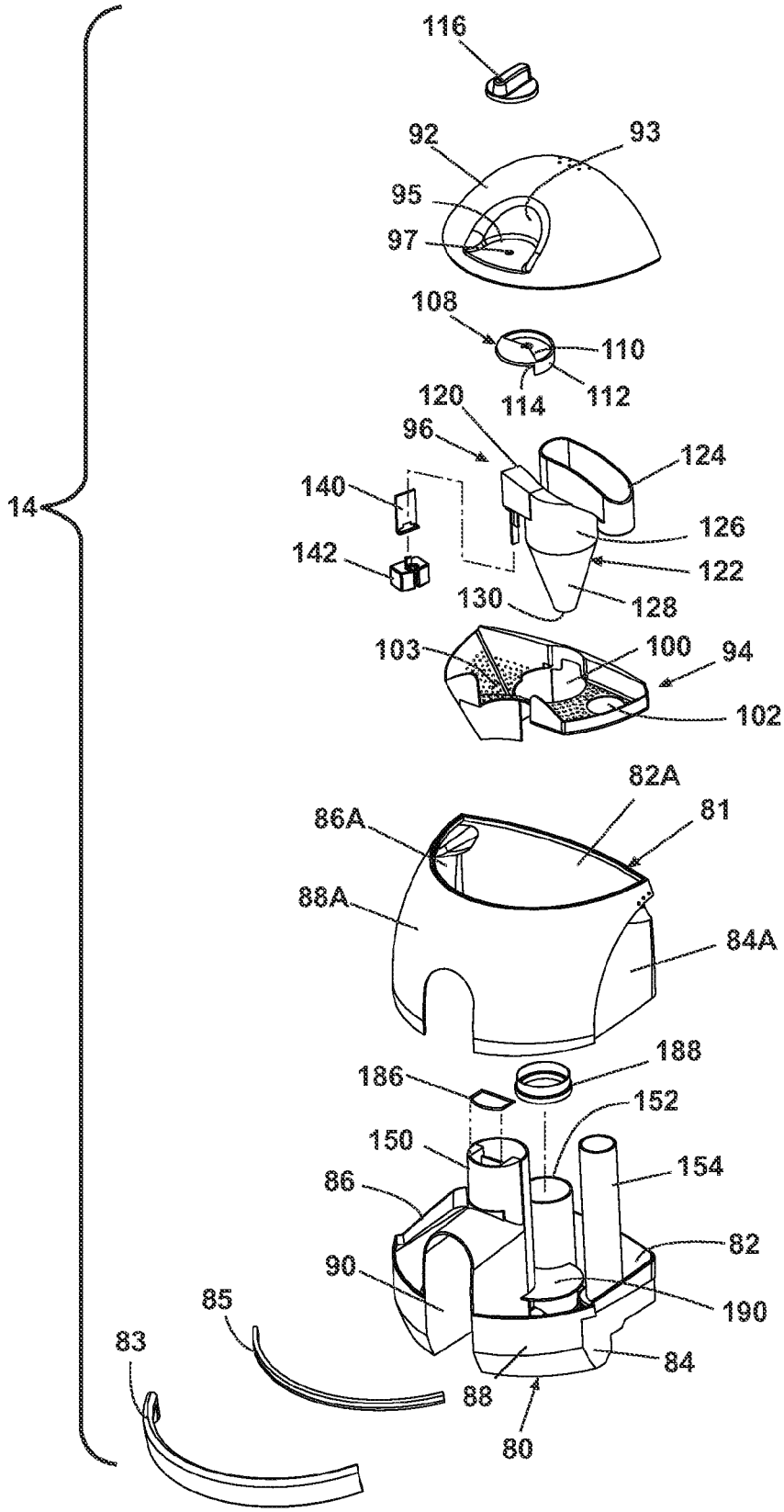
FIG. 5 is an exploded view of a recovery tank of the vacuum cleaner of FIG. 1.
Figure 6:
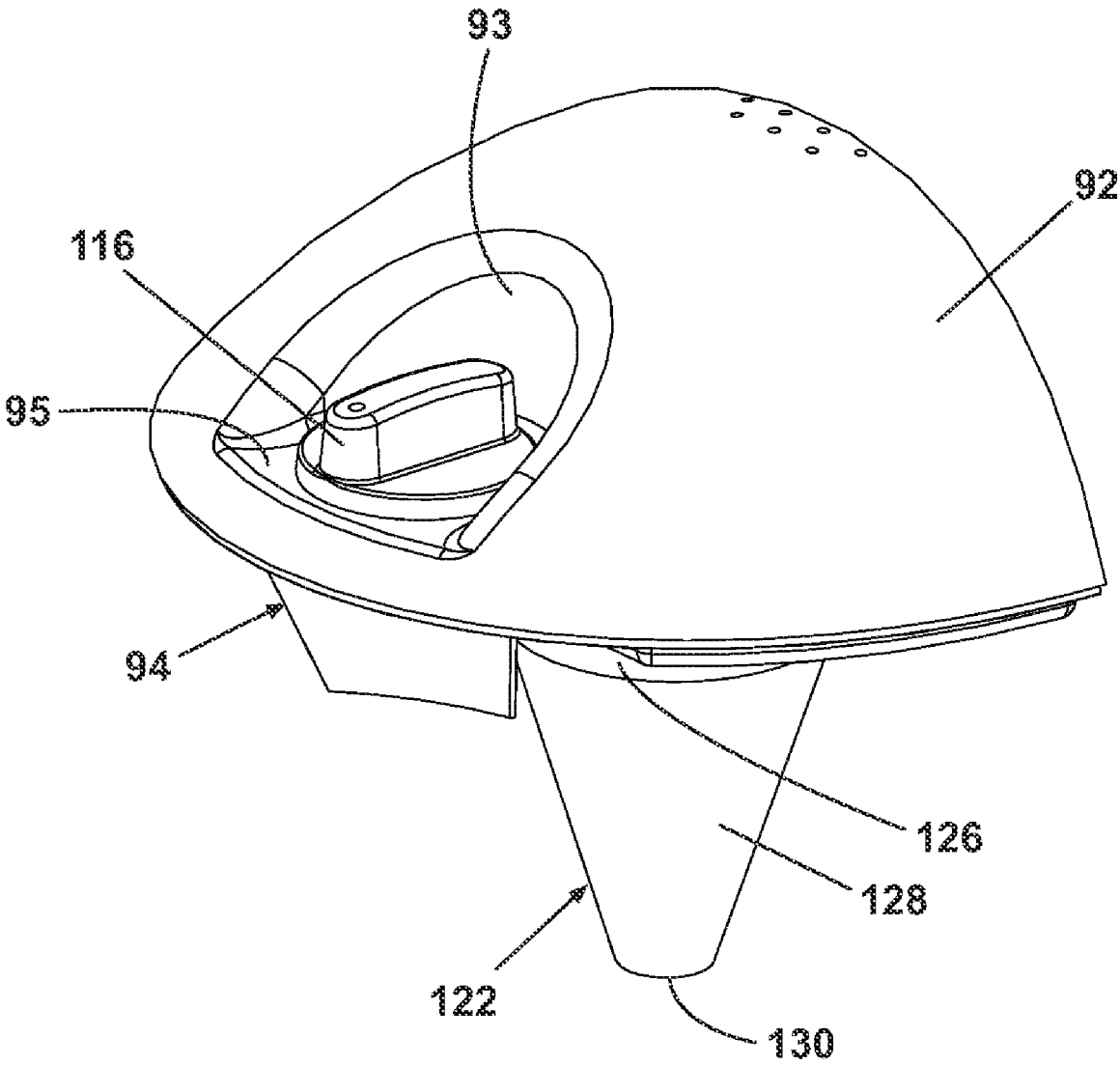
FIG. 6 is a perspective view of a cover, a diverter assembly, and a cyclone assembly of FIG. 5.

Referring to FIGS. 5 and 6, the recovery tank 14 has a bottom portion 80 comprising a back wall 82, two opposing sidewalls 84, 86, and a front wall 88. A recessed portion 90 surrounds the hose interface 20 (FIG. 3) and extends from the bottom portion 80. A bumper 83 is attached to the front wall 88 to protect furniture from damage as the canister is moved about a room. A bumper reinforcement 85 is placed between the bumper 83 and the front wall 88 to stiffen the bumper. A transparent casing 81 is attached to the bottom portion 80 and comprises walls 82*a*, 84*a*, 86*a*, and 88*a* that extend from walls 82, 84, 86, and 88 of the bottom portion 80. The recovery tank 14 is removably mounted to the base 12 such that it is received in the first recess 48 on the base 12 and the back wall 82 abuts the partition 46. A removable cover 92 has a concave recess 93 that includes a bottom surface 95 with an aperture 97 and is positioned in the opening created by the upper edges of walls 82, 84, 86, and 88. The cover 92 is preferably made from a transparent material so that the contents of the recovery tank 14 can be viewed by the user. A screen 94, a cyclone separator assembly 96, and a diverter valve 108 are mounted to the underside of the cover 92 and removable therewith to provide clear access to the interior of the casing 81 when the cover 92 is removed. The clear space within the casing 81 facilitates easy emptying of the recovered contents. Three hollow stand conduits 150, 152, 154 extend vertically from the bottom wall 80 of the recovery tank 14. The recovery tank 14 is adapted to hold a predetermined amount of water as a bath that serves as a first stage filtering means.

Figure 7:
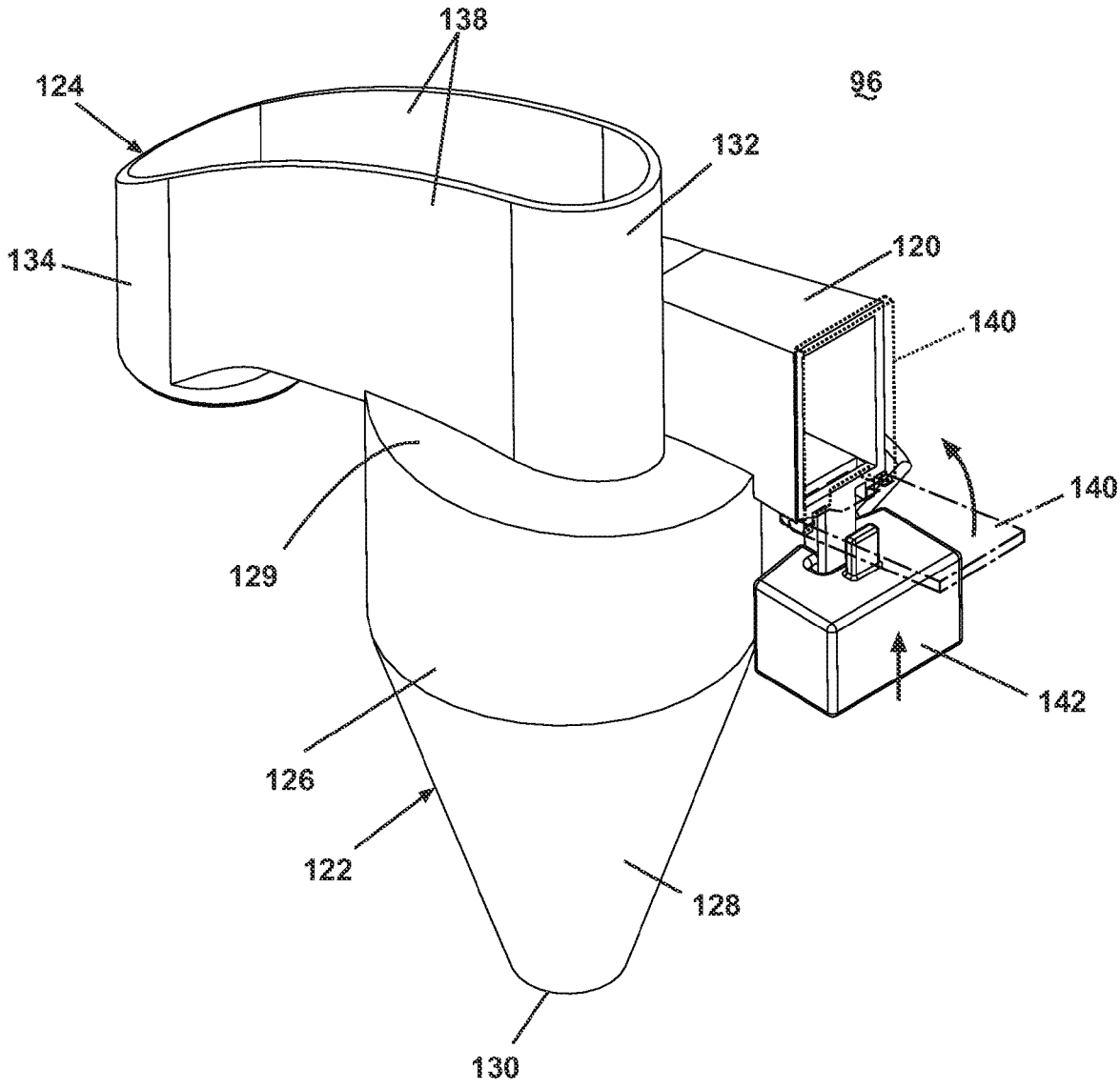
FIG. 7 is a top quarter perspective view of the cyclone assembly of FIG. 6.

Referring to FIG. 7, the cyclone assembly 96 functions as a second stage filter and comprises an air inlet conduit 120, a cyclone separator 122, and an air outlet conduit 124. Such cyclone assemblies are well-known in the dry vacuum cleaner art. A suitable cyclone separator is described in U.S. Pat. No. 4,571,772 to Dyson which is incorporated herein by reference in its entirety. The cyclone separator 122 has a hollow cylindrical portion 126 that is connected to a helical top wall 129 and to a truncated cone portion 128 with a debris opening 130. The inlet conduit 120 is positioned tangentially to the cylindrical portion 126 in order to introduce the air into the cylindrical portion 126 tangentially along the inner wall surface of the cylindrical portion 126 to form a well-known cyclonic airflow pattern. The air outlet conduit 124 has a curved vertical end wall 132 that communicates with the interior of the cyclonic separator 122 through an exhaust tube 133 (FIG. 10) in the top wall 129, a pair of vertical side walls 138 and a curved end wall 134. As mentioned above, the cyclone assembly 96 is joined to the cover 92 along the air outlet conduit 124. Thus, the cyclone assembly 96 is removable with the cover and a separate lid is not required for the cyclone assembly 96.

A shut-off valve 140 is hinged to the inlet conduit 120 and is operated by a float 141 to close the opening to the inlet conduit 120 to prevent water from entering the cyclone assembly 96. As water in the recovery tank 14 rises, the float 141 will also rise and engage the shut-off valve such that the valve eventually swings upward to seal off the inlet conduit 120 to the cyclone assembly 96.

The diverter valve 108 is cylindrical and comprises a top surface 110, a side wall 112, and an aperture 114 formed in the side wall 112 and has an outer diameter sized to engage the upper end of the diverter stand conduit 150. A knob 116 is rotatably mounted to the bottom 95 through a pin 118 that extends through the aperture 97 and is non-rotatably connected to the diverter valve 108 through the pin 118. The knob 116 is located on an upper external surface of the vacuum cleaner 10 so that the knob is easily accessible to the user.

The screen 94 is attached the underside of the cover 92 and is shaped such that the screen 94 covers substantially the bottom of the cover 92. The screen 94 comprises a plurality of perforations and is formed with a first hole 100 that fits around the cyclone assembly 96. A second hole 102 and an aperture 103 that is formed on one side of the screen 94 receives the stand conduits 154 and 150, respectively when the cover is placed on the recovery tank. Although the vacuum cleaner 10 is most effective when a water bath filter is used, it can also be operated in a dry mode with an empty recovery tank. The screen 94 prevents large particles of dirt from entering the cyclone assembly 96.

The vacuum cleaner 10 can selectively be switched between wet and dry vacuuming modes by rotation of the diverter valve 108 in relation to the stand conduit 150. When the diverter valve 108 is in an "open position" used for wet vacuuming, the aperture 114 is oriented toward the front of the vacuum cleaner 10. When the diverter valve 108 is in a "closed position" used for dry vacuuming the sidewall 112 is oriented toward the front of the vacuum cleaner 10 so that working air is forced down the standpipe 150 into a water bath. The external diverter knob 116 is connected to the diverter valve 108 so that a user can rotate the diverter valve 108 between the wet and dry vacuuming positions. Markings can be included on the bottom surface 95 to indicate the selected mode to the user.

Figure 8:
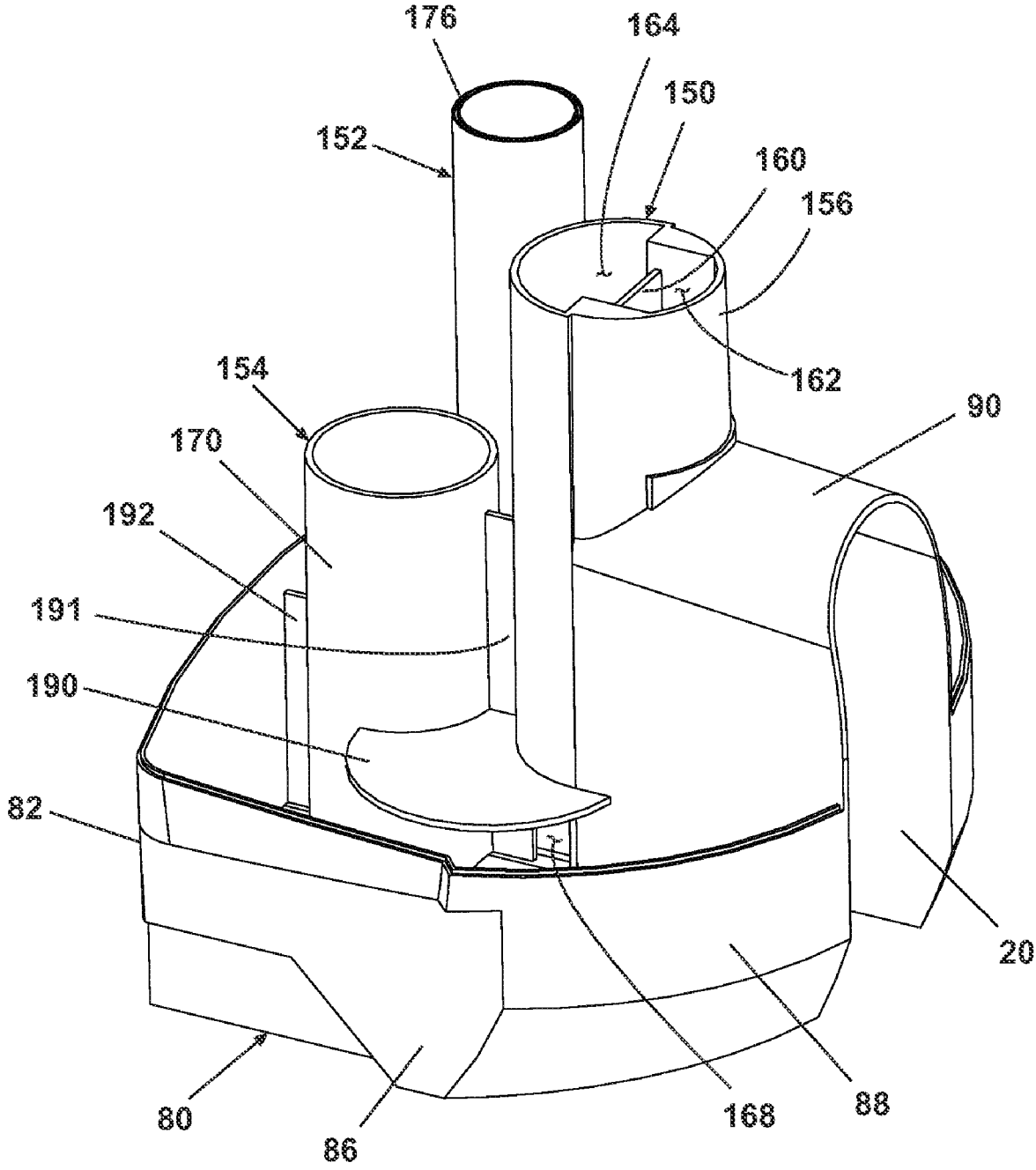
FIG. 8 is a top quarter perspective view of a bottom portion of the recovery tank of FIG. 5 with the side walls removed for clarity.
Figure 9:
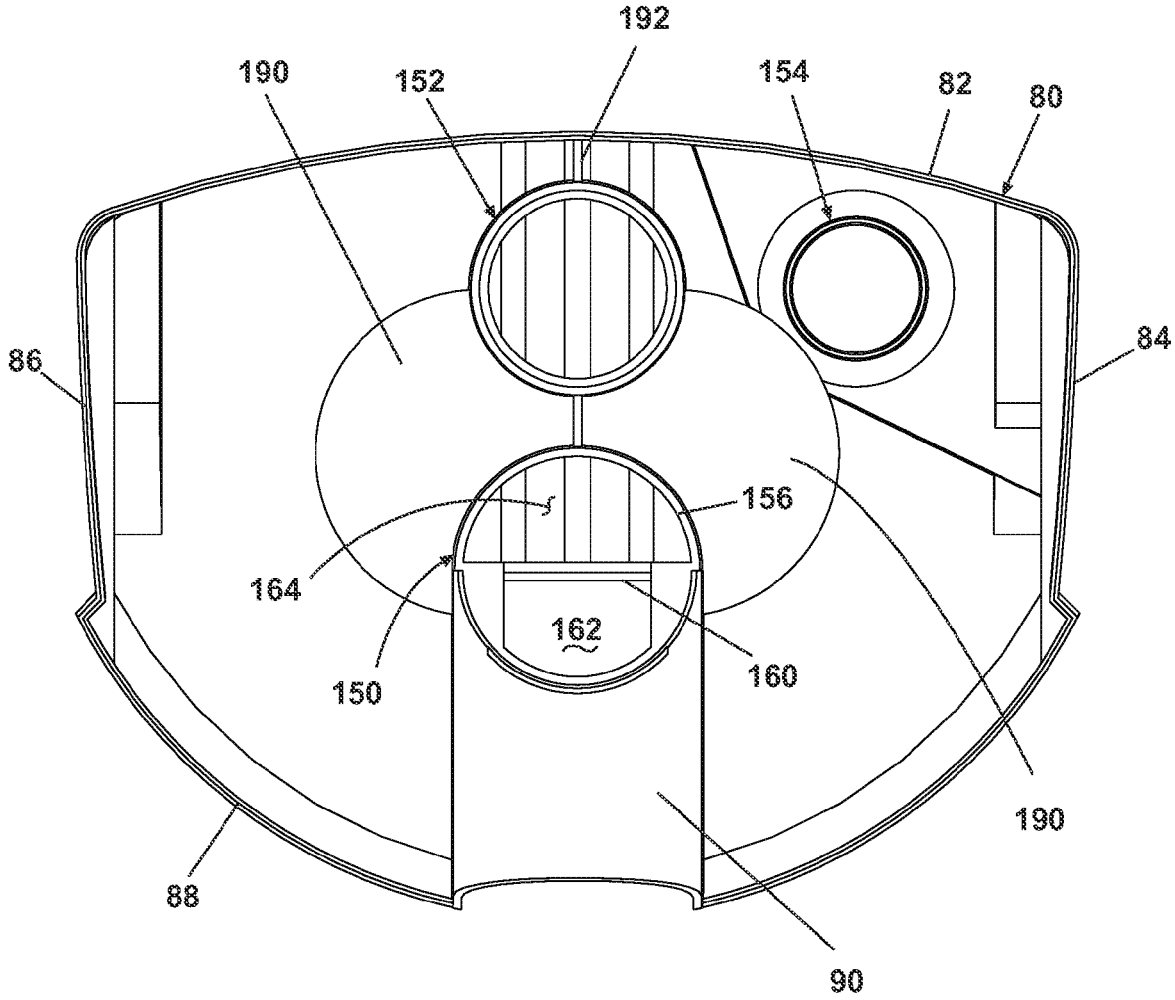
FIG. 9 is a top view of the bottom portion of the recovery tank of FIG. 8 with the upper portion of the recovery tank removed.

Referring to FIGS. 8 and 9, a first rib 191 connects the diverter stand conduit 150 to the debris stand conduit 152 and a second rib 192 connects the debris stand conduit 152 to the back wall 82. A deflector plate 190 extends horizontally from the diverter stand conduit 150 and the debris stand conduit 152 above a water bath inlet opening 168 formed near the bottom of the diverter stand conduit 150. This deflector plate 190 controls the water spray that is created when the air impinges on the water surface and enters into the water bath 78.

Figure 10:
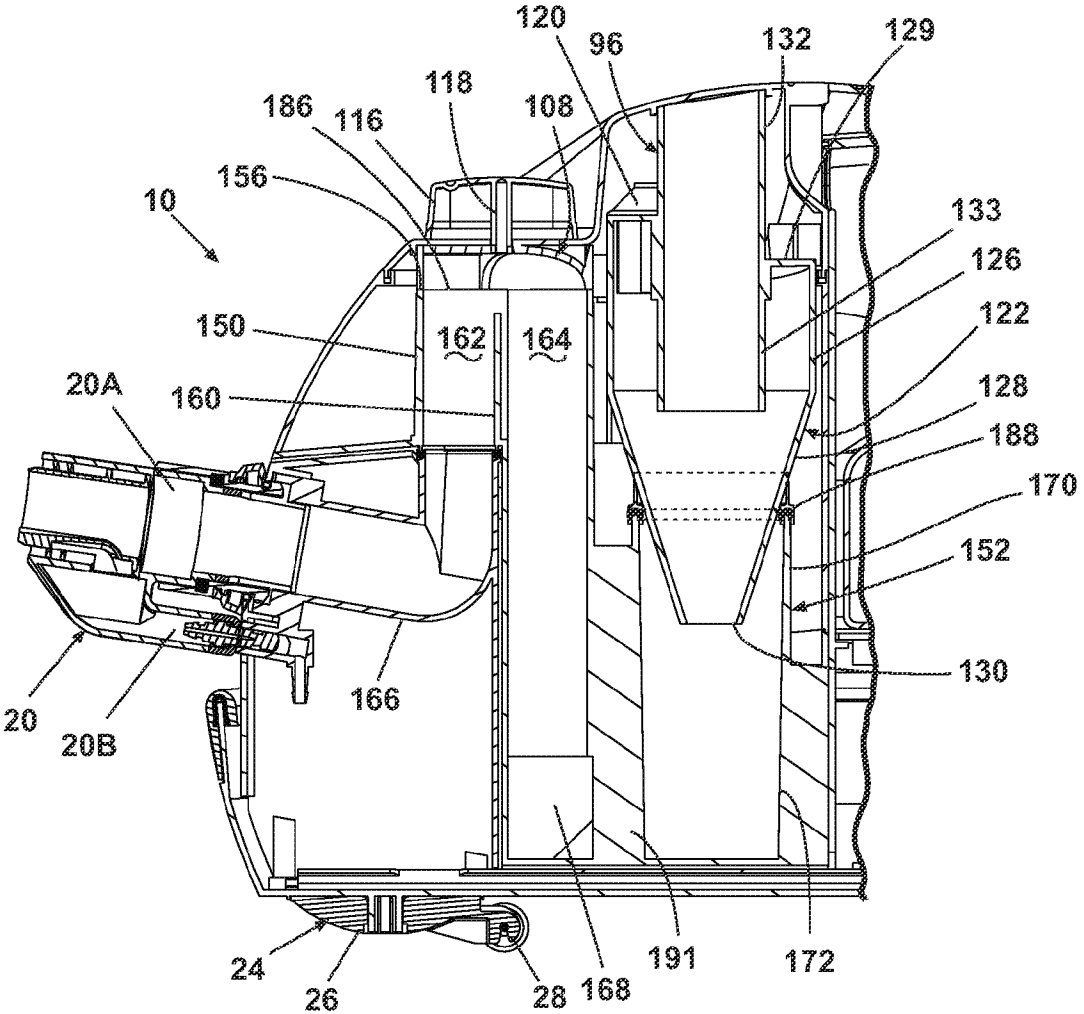
FIG. 10 is a partial sectional view taken along line 10-10 of FIG. 2.

Referring to FIG. 10, the diverter stand conduit 150 is cylindrical in shape with an upper edge 156 that is received by the diverter valve 108 and has a wall 160 that divides the interior of the stand conduit into a first conduit 162 and a second conduit 164 The first conduit 162 communicates with an L-shaped conduit 166 that extends to the hose interface 20 and the second conduit 164 communicates with the water bath via the water bath inlet opening 168 at the lower end of the stand conduit 150.

The debris stand conduit 152 is a hollow cylinder that has an upper end 170 and a lower end 172. The upper end 170 communicates with the debris opening 130 of the cyclone separator 122 such that dirt that is separated in the cyclone separator 122 will fall under force of gravity through the opening 130 and into the debris stand conduit 152.

Figure 11:
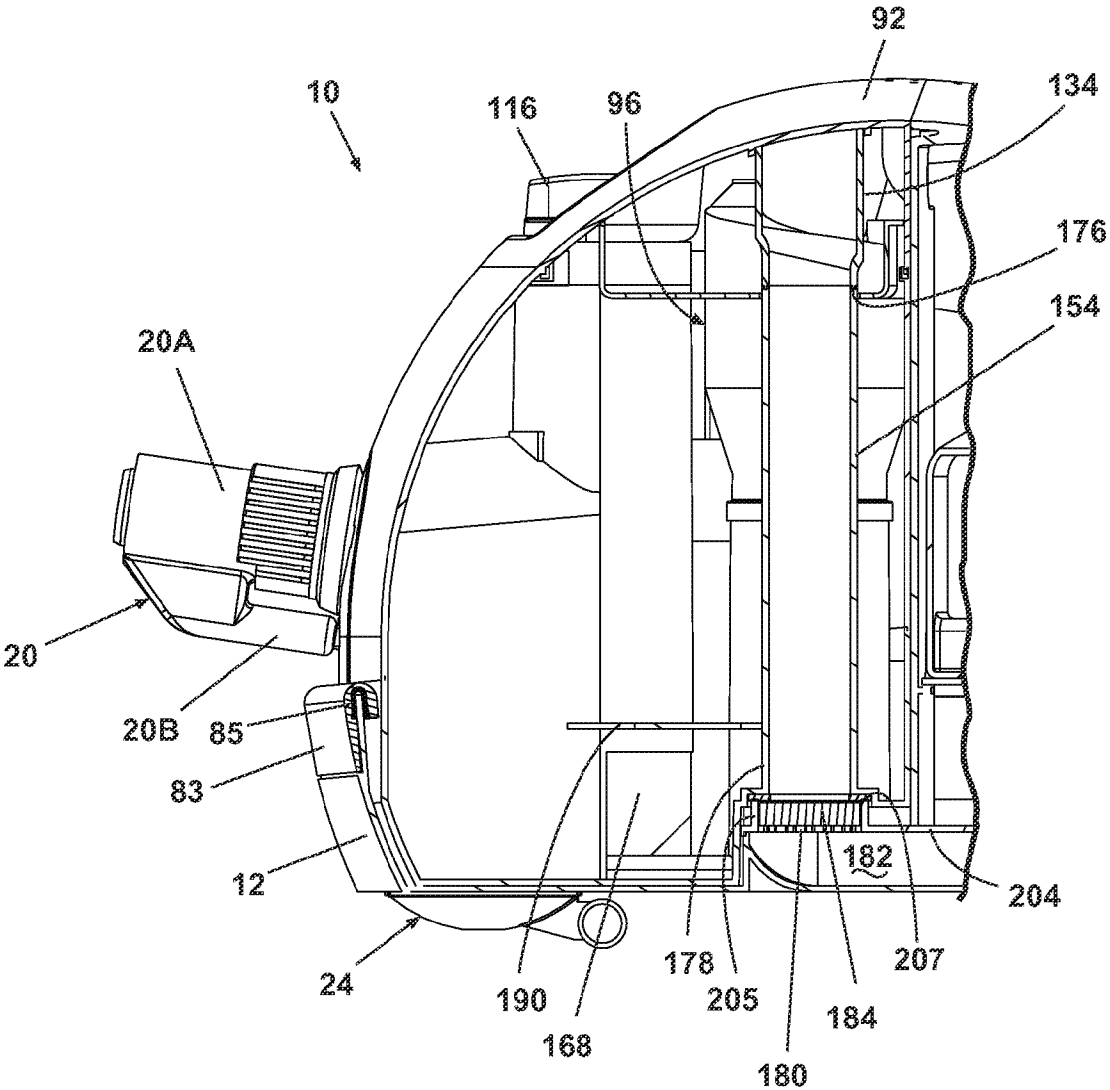
FIG. 11 is a partial sectional view taken along line 11-11 of FIG. 2.

Referring to FIG. 11, the exhaust stand conduit 154 is a hollow cylinder with an upper end 176 and a lower end 178. The upper end 176 is dimensioned to fit within the end wall 134 on the cyclone assembly 96 when the cover 92 is on the recovery tank 14. The lower end 178 has an air outlet aperture 180 in communication with a working air conduit 182 leading to a suction source comprising a motor/fan assembly 210.

A coarse filter 184 can be placed between the air outlet aperture 180 and the working air conduit 182. This filter 184 is useful, as is the screen 94, when operating the vacuum cleaner 10 with an empty (no water) recovery tank 14. The course filter can be a conventional foam filter that traps particles passing therethrough to prevent damage to the motor/fan assembly 210.

A seal 186 is mounted between the upper edge 156 of the diverter stand conduit 150 and lip 102 on the diverter cylindrical valve housing 94 and another seal 188 is mounted between the debris stand conduit 152 and the debris opening 130 on the cyclone separator 122, respectively. Both seals 186, 188 are located above the maximum recommended water bath level in the recovery tank 14. Effective seals are desired to prevent unwanted water and air leakage through the system that could reduce the effectiveness of the working air flow or mechanically damage the suction source. The working air components may be repeatedly connected and disconnected during the removal of the cover from the recovery tank to empty or fill the recovery tank, the seals may become susceptible to water leaks. Positioning the seals above the maximum recommended water bath height further minimizes air or water leaks during cleaning operations.

Figure 12:
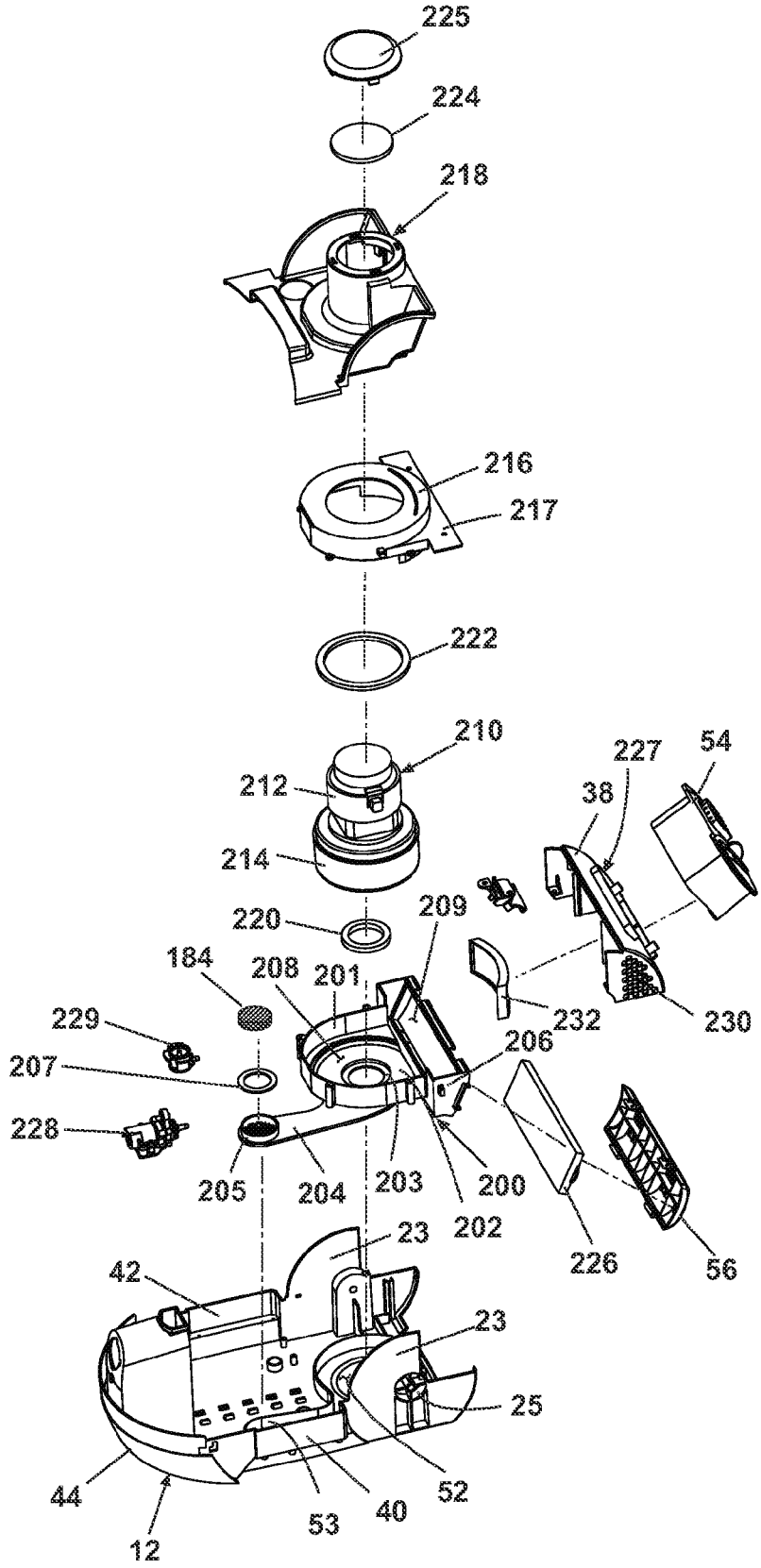
FIG. 12 is an exploded view of the base assembly of the vacuum cleaner of FIG. 1.

Referring to FIG. 12, the suction source assembly comprises an air inlet housing 200 having a wall 201 around the perimeter of the housing, a bottom surface 202 with a circular aperture 203, a connecting conduit 204 extending from the wall 201 and having a cylindrical fitting 205, and an exhaust conduit 206 depending from the wall 201 received in the third recess 52 on the base 12. The cylindrical fitting 205 is received by the lower end 178 of the exhaust stand conduit 154 (FIG. 11) that communicates with the air outlet aperture 180 to form a working air conduit 182 defined by connecting conduit 204 between air outlet aperture 180 and aperture 203 when the recovery tank 14 is in place on the base 12. A sealing gasket 207 is located between the cylindrical fitting 205 and the lip 178. The cylindrical wall 201 defines a cavity 208 and comprises an exhaust aperture 209 that communicates with the exhaust conduit 206.

The vertically-oriented motor/fan assembly 210 comprises a motor assembly 212 and a fan assembly 214. The fan assembly 214 sits in cavity 208 and is enclosed by a retaining cover 216. A horizontal plate 217 extending from the cover 216 mates with the exhaust conduit 206 to form a horizontal wall of the conduit. A motor/fan assembly casing 218 encloses the entire suction source assembly. Sealing gaskets 220 and 222 are mounted between the bottom surface 202 and the fan assembly 214 and between the motor assembly 212 and the retaining ring 216, respectively. A third gasket 224 is mounted between the motor assembly 212 and a motor cover 225 to reduce noise and vibration of the motor/fan assembly 210.

A HEPA filter 226 is disposed between the exhaust aperture 209 and the exhaust grill 56. The exhaust grill 56 is removable to provide access to the HEPA filter 226 to provide easy access for removal and cleaning or replacement as necessary. The vacuum cleaner 10 further comprises a pump 228 mounted in the base to move fluid from the clean solution tank 18 through an in-line heater (not shown) also mounted in the base that elevates the temperature of the cleaning solution and through the hose 16. Separate switches for the pump 228 and the heater (not shown) can be provided. A steam generating apparatus can also be incorporated into the vacuum cleaner 10. An example of such an apparatus is described more fully in the Sham U.S. Pat. No. 5,819,364 or the Baldacci U.S. Pat. No. 5,920,952, both of which are incorporated by reference in their entirety.

A cooling air housing 227 is mounted to the base 12 such that the housing 227 abuts casing 218 and includes back wall 38 and cord wrap 54. The cooling air housing 227 further includes a plurality of hemispherical exhaust grills 230 that allow air used to cool the motor assembly 212 to pass therethrough. A coarse filter 232 for the motor cooling air is located in the airpath between the motor assembly 212 and the grills 230 to filter any remaining dirt out of the air before it is exhausted from the vacuum cleaner. Air gaps are formed between the exhaust grills 230 and the wheels 22 to allow exhaust air to exit the space around the wheels 22. The filter 232 is sized to capture carbon dust particles that may enter the motor cooling air path. In an alternate embodiment, the motor cooling air can be directed into the working air path so that the motor cooling air intermingles with the vacuum working air and passes through the HEPA filter 226 before being exhausted to the environment. The alternate embodiment eliminates the need for multiple filters.

Figure 13:
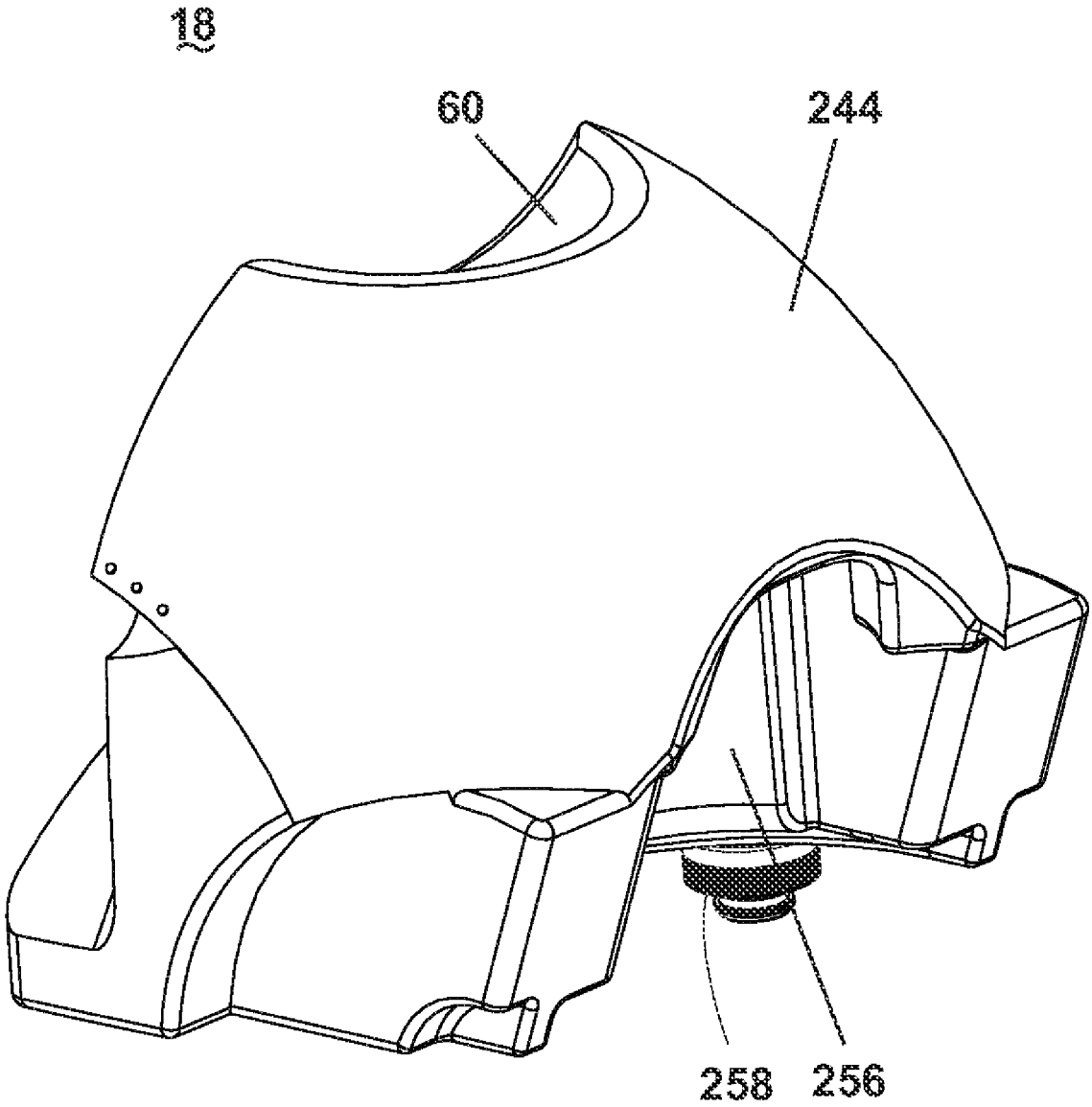
FIG. 13 is a top quarter perspective view of a clean solution tank of FIG. 1.

Referring to FIG. 13, the clean solution tank 18 comprises a commonly known integrally formed tank comprising a sloped top wall 244. The clean solution tank 18 has a recess 256 shaped to complement the outer shape of the motor/fan assembly casing 218. A commonly known check valve 258 is located on the bottom of the clean solution tank 18 that is received by a corresponding socket 229 (FIG. 12) in the base 12 to open the valve 258 when the tank 18 is mounted on the base 12. To fill the clean solution tank 18, the user inverts the tank, removes the valve 258 and pours solution through the opening in the top wall 244. Typically, the cleaning solution comprises a combination of water and detergent. A tube 260 conveys cleaning solution from the tank 18 through the heater (not shown) to the clean solution conduit 20*b* where the solution is distributed onto the floor to be cleaned by a floor nozzle. The tube 260 is held in place by the track 49.

Figure 14:
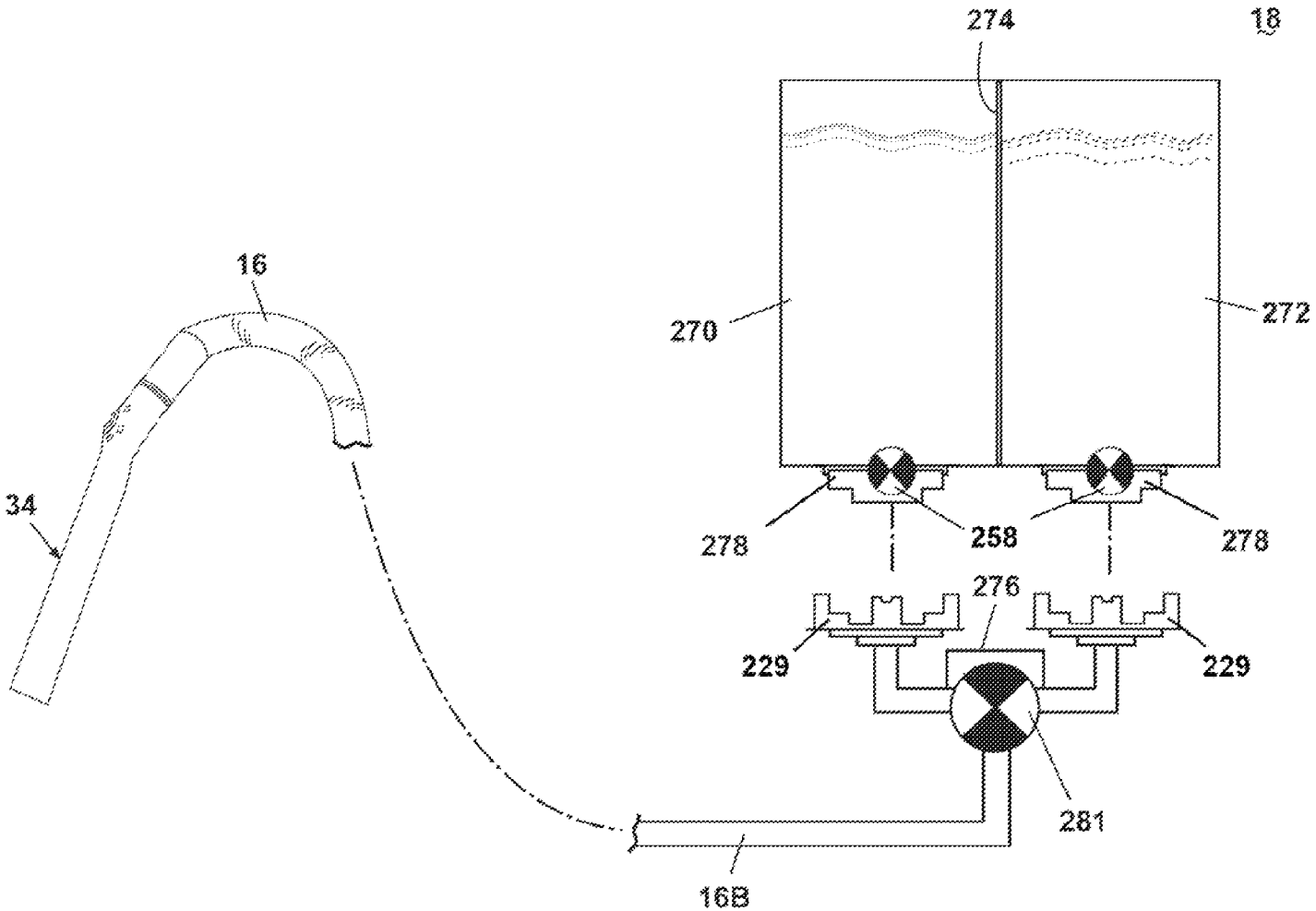
FIG. 14 is a schematic representation of a second embodiment of the clean solution tank of FIG. 13 comprising an automatic solution mixer.

Referring to FIG. 14, an alternate embodiment for the clean solution tank 18 is illustrated that incorporates an automatic mixer to mix cleaning detergent and solution pumped from separate holding tanks to a distributor for application to a surface to be cleaned. The clean solution tank 18 is divided into a solution compartment 270 and a detergent compartment 272 by a dividing wall 274. Two spring-loaded valves 258 in an outlet opening of the compartments 270 and 272 are biased to a closed position when the tank 18 is removed from the vacuum cleaner to control the flow of water and detergent into a mixing chamber 276 and valve 281 controls the flow of the mixed cleaning solution into a clean solution conduit 16*b* of the hose 16. The valves 258 have female fittings 278 located on the tank 18. Male fittings on the sockets 229 located on the vacuum cleaner base couple to the female fittings when the tank 18 is mounted on the vacuum cleaner to open the valves 258.

Figure 15:
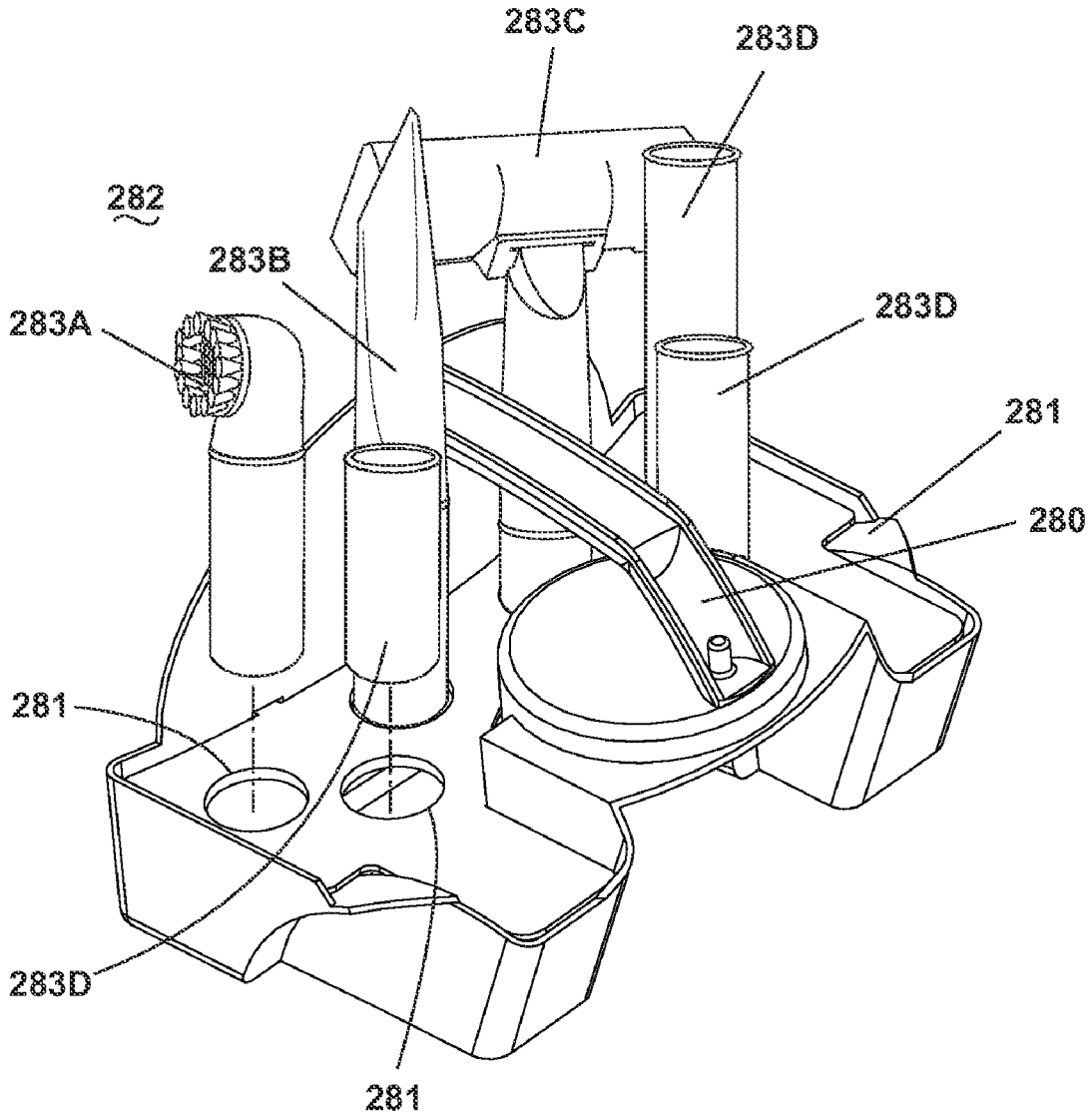
FIG. 15 is a perspective view of a tool caddy that can be attached to the vacuum cleaner of FIG. 1 in place of the clean solution tank.

Referring to FIG. 15, a tool caddy 282 can be placed on top of the motor/fan assembly casing 218 in lieu of the clean solution tank 18. Since the clean solution tank 18 is not used during dry vacuum cleaning, it is convenient to have accessory tools readily available that can be attached to the hose 16 in place of a floor nozzle 286, 286. This interchangeability reduces the size and weight of the vacuum cleaner 10 for cleaning operations since the clean solution tank 18 and the tool caddy 282 are interchangeable. The tool caddy 282 has substantially the same external side and lower shape as the clean solution tank 18 (FIG. 13). Common features between the tool caddy 282 and the clean solution tank 18 are referred to with the same reference number bearing a prime symbol (').

The tool caddy 282 further comprises a handle 280 and multiple depressions 281 that are sized to receive the tools for convenient storage thereon such as a bristle brush 283*a*, a crevice tool 283*b*, an upholstery brush 283*c*, and extension tubes 283*d*.

Figure 16A:
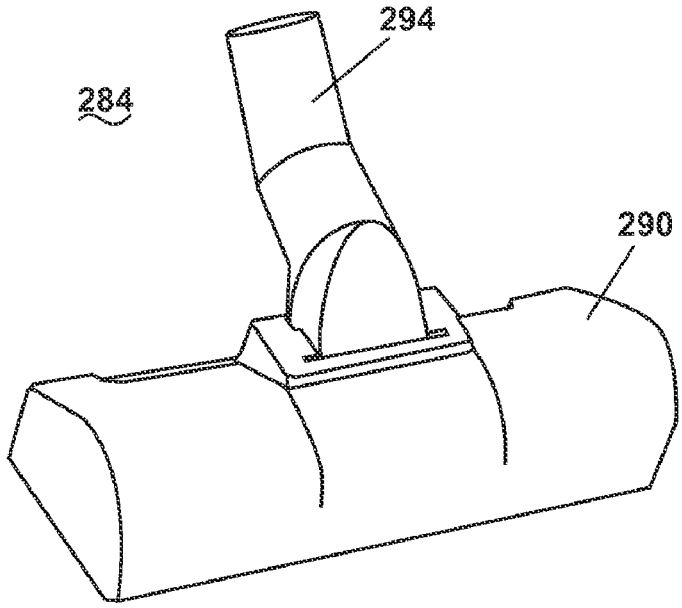
FIG. 16*a* is a top perspective view of a dry vacuuming nozzle that can be attached to the vacuum cleaner of FIG. 1.
Figure 16B:
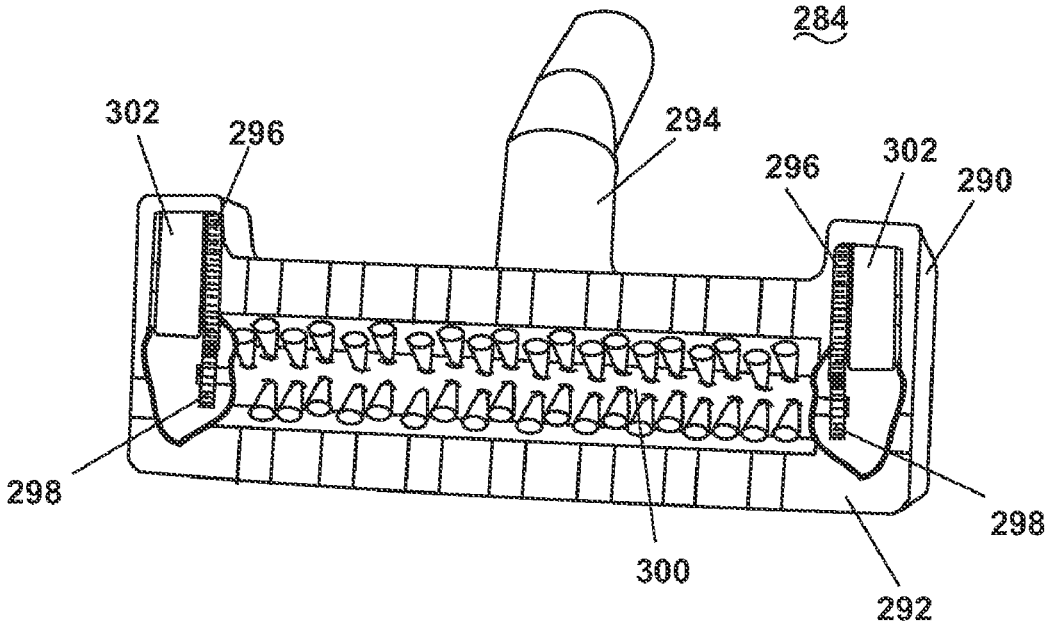
FIG. 16*b* is a bottom perspective view of the dry vacuuming nozzle shown in FIG. 16*a* with portions cut away to illustrated a geared brushroll.

Multiple floor nozzles 284, 286 are provided for attachment to the grip 34 or wand 34*a*, wherein each nozzle 284, 286 is used for a different cleaning mode. A conventional dry vacuuming nozzle having a turbine-driven brushroll can be provided or, as shown in FIGS. 16*a* and 16*b*, a dry vacuuming nozzle 284 having a mechanical brushroll 300 can be provided. The nozzle 284 has a top enclosure 290 mounted on a frame 292 and has a connection conduit 294 that attaches to the wand receiving end 34*b* on the wand 34*a*. A pair of wheels 302 are coupled to drive gears 296 that rotate when the wheels 302 turn due to friction between the wheels and the surface to be cleaned. The drive gears 296 mesh with driven gears 298 that are coupled to the brushroll 300 to transmit rotary motion from the drive gears 296 to the brushroll 300. The wheels 302 and brushroll 300 rotate in the opposite direction such that as the dry vacuuming nozzle 284 is pushed forward, the wheels 302 rotate toward the user and the brushroll 300 rotates away from the user standing behind the nozzle. Alternately, as the nozzle 284 is pulled back, the wheels 302 and the brushroll 300 will rotate in the opposite direction.

Figure 17A:
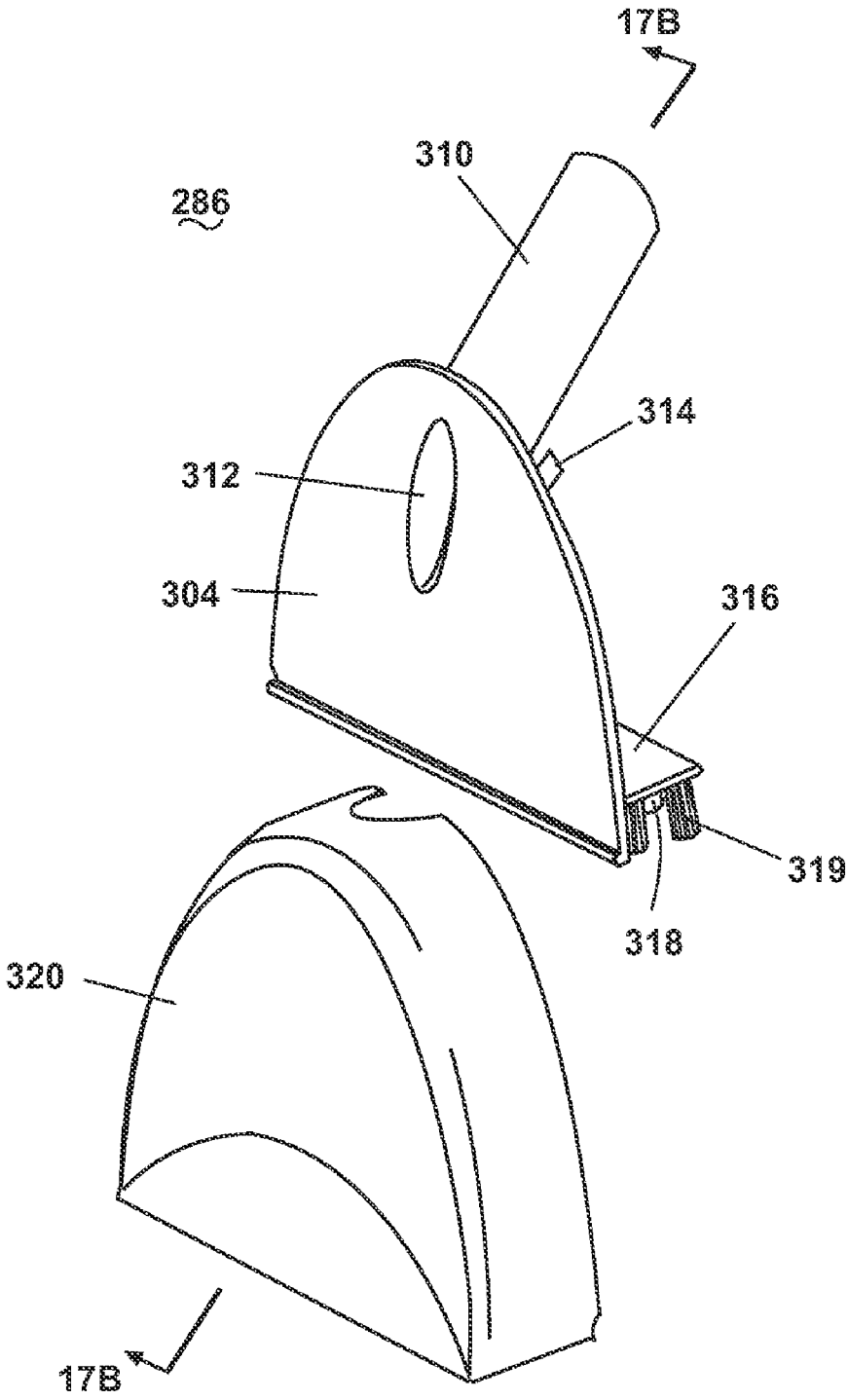
FIG. 17*a* is a perspective view of a wet extraction nozzle that can be attached to a hose on the vacuum cleaner of FIG. 1.
Figure 17B:
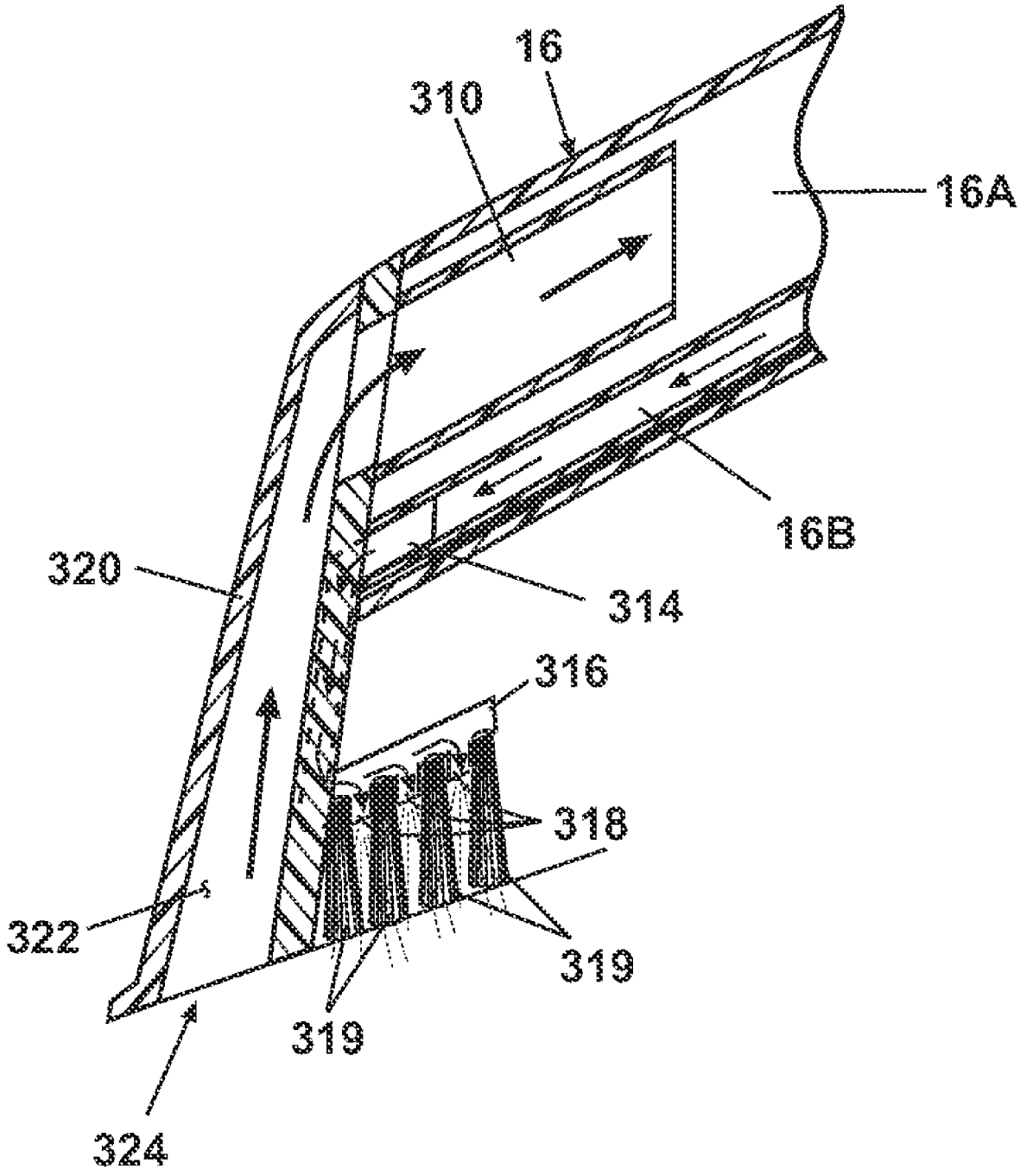
FIG. 17*b* is a sectional view taken along line 17*b*-17*b* of FIG. 17*a*.

Referring to FIGS. 17*a* and 17*b*, a commonly known wet extraction nozzle 286 comprises a plate 304 with a connection conduit 310 for connecting the hose 16 extending at an angle from the plate 304 wherein a suction opening 312 is formed in the plate 304. A second connection conduit 314 for connecting the solution conduit 16*b* extends from the first surface 306 below the first connection conduit 310 and communicates with a hollow protrusion 316 that extends laterally from the first surface. The protrusion 316 and has multiple apertures 318 to distribute cleaning solution from the clean solution tank 18 onto a carpeted surface and bristles 319 to scrub the carpeted surface. A cover 320 mounts in spaced relation to the plate 304 creating a space 322 that forms a suction inlet 324. The suction inlet 324 and space 322 allows dirty solution to be drawn into the suction conduit 16*a* of the hose 16 and returned to the recovery tank 14. A wet extraction nozzle is more fully described in U.S. Pat. No. 4,333,203 to Yonkers which is incorporated herein by reference in its entirety.

Figure 18:
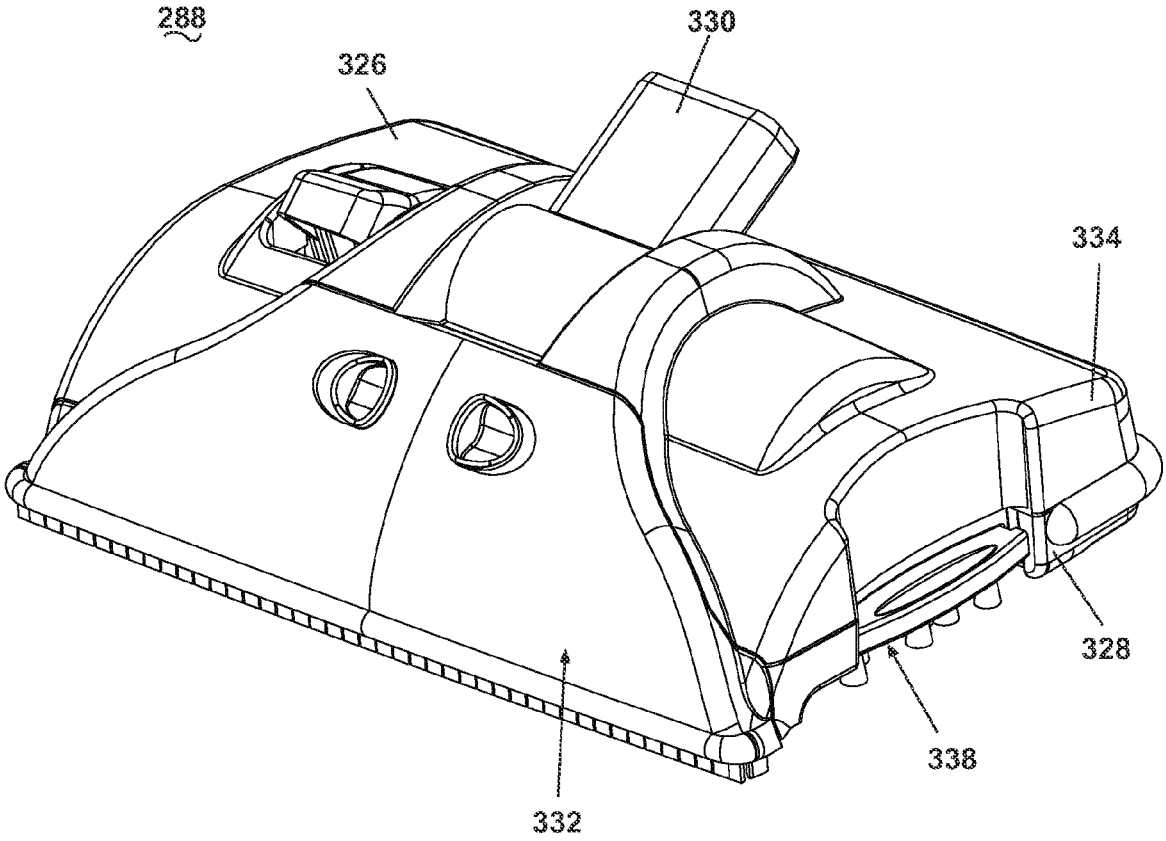
FIG. 18 is a is a perspective view of a bare floor nozzle that can be attached to the hose of the vacuum cleaner of FIG. 1 and comprising wet and dry nozzle assemblies.
Figure 19:
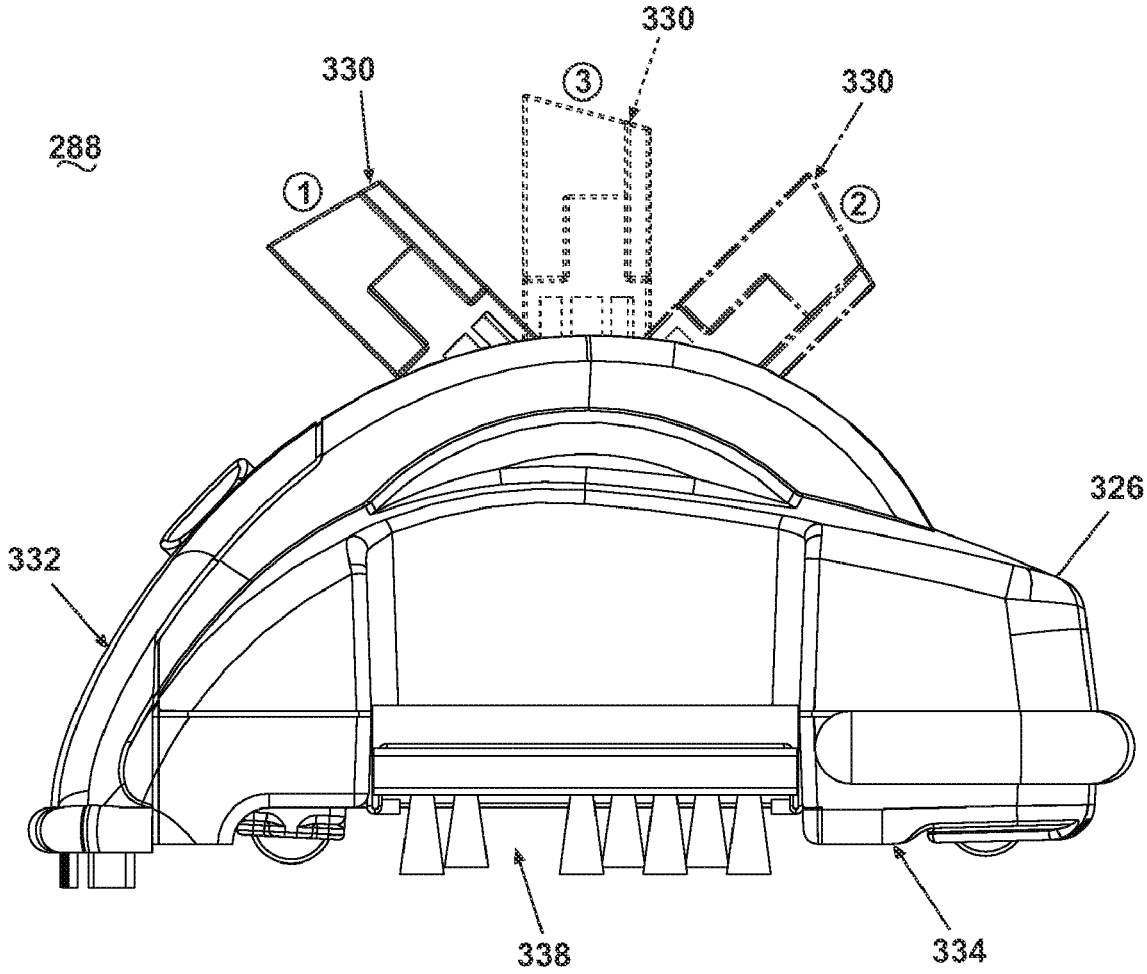
FIG. 19 is a side view of the bare floor nozzle of FIG. 18.

Referring to FIGS. 18 and 19, a bare floor cleaning head 288 comprises a top enclosure 326 mounted to a frame 328 to define a cavity therebetween that houses several components of the bare floor cleaning head 288. The frame 328 provides structural support for several of the nozzle components, such as a pivotable connector 330 for connecting to the grip 34 on hose 16, wet and dry nozzle assemblies 332, 334 on opposite sides of the bare floor cleaning head 288 for suctioning wet and dry debris, respectively, from the surface to be cleaned, and an agitator assembly 338.

Referring particularly to FIG. 19, rotation of the grip 34 between the first and second positions induces rotation of the pivotable connector 330. When the handle is pivoted to the first position, the wet nozzle assembly 332 is raised off the surface to be cleaned. This configuration corresponds to a dry vacuuming operational mode for bare floor bare floor cleaning head 288 and is achieved when the grip 34, which is connected to the pivotable connector 330, rotates towards the wet nozzle assembly 332 to the first position (i.e., the handle position indicated by the number 1 in FIG. 19). When the grip 34 is in the first position, the dry nozzle assembly 334 is in front of the wet nozzle assembly 332. When the grip 34 rotates in the opposite direction to the second position (i.e., the handle position indicated by the number 2 in FIG. 19), the wet nozzle assembly 332 is lowered and contacts the surface to be cleaned. When the grip 34 is in the second position, the wet nozzle assembly 332 is in front of the dry nozzle assembly 334. This configuration corresponds to a wet cleaning mode of the bare floor cleaning head 288. A suitable bare floor cleaning head is disclosed in PCT/US2004/026952 which is incorporated herein by reference in its entirety.

Figure 20:
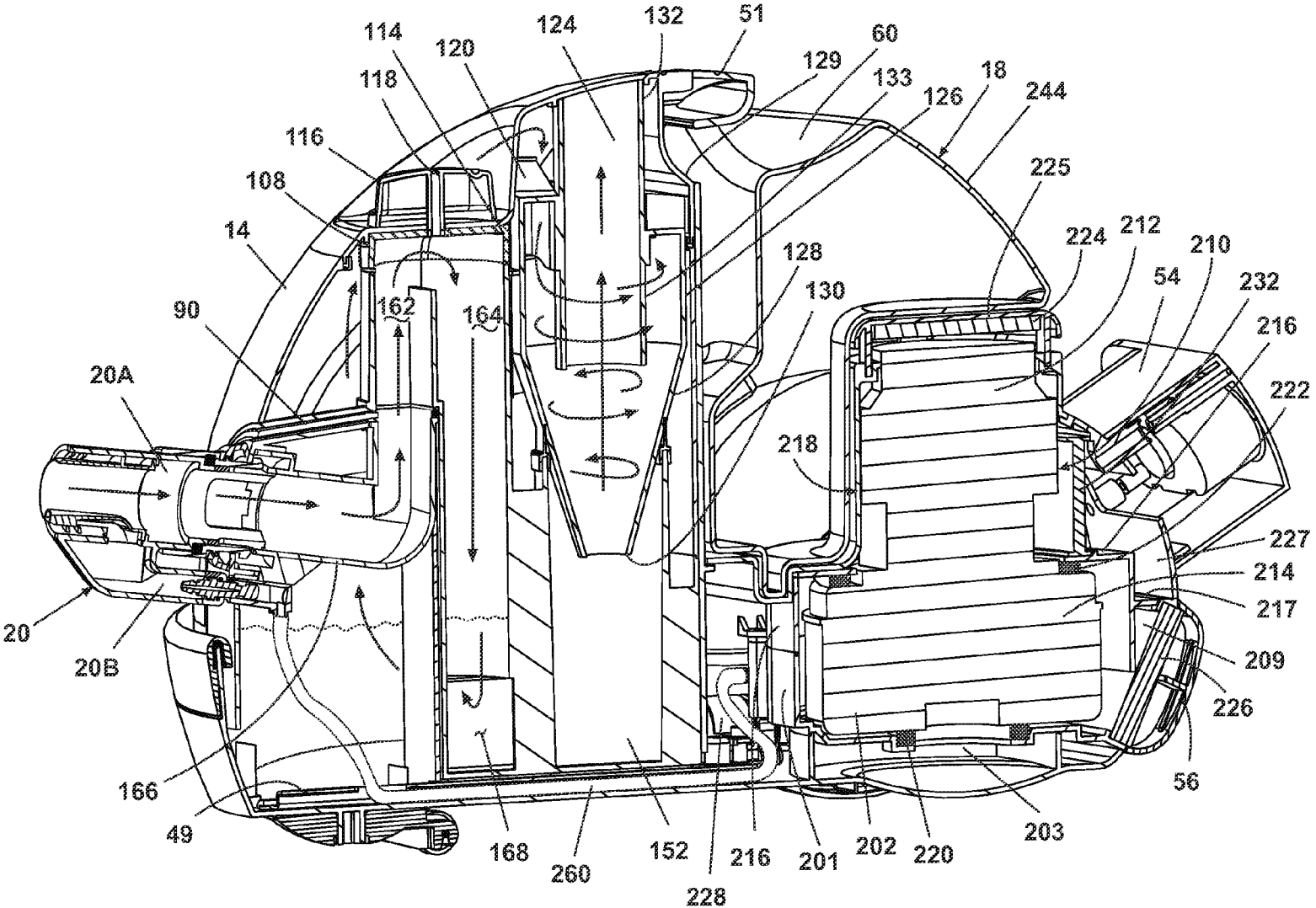
FIG. 20 is a sectional view taken along line 10-10 of FIG. 2 showing a first portion of an air path through the vacuum cleaner of FIG. 1 during dry vacuuming.
Figure 21:
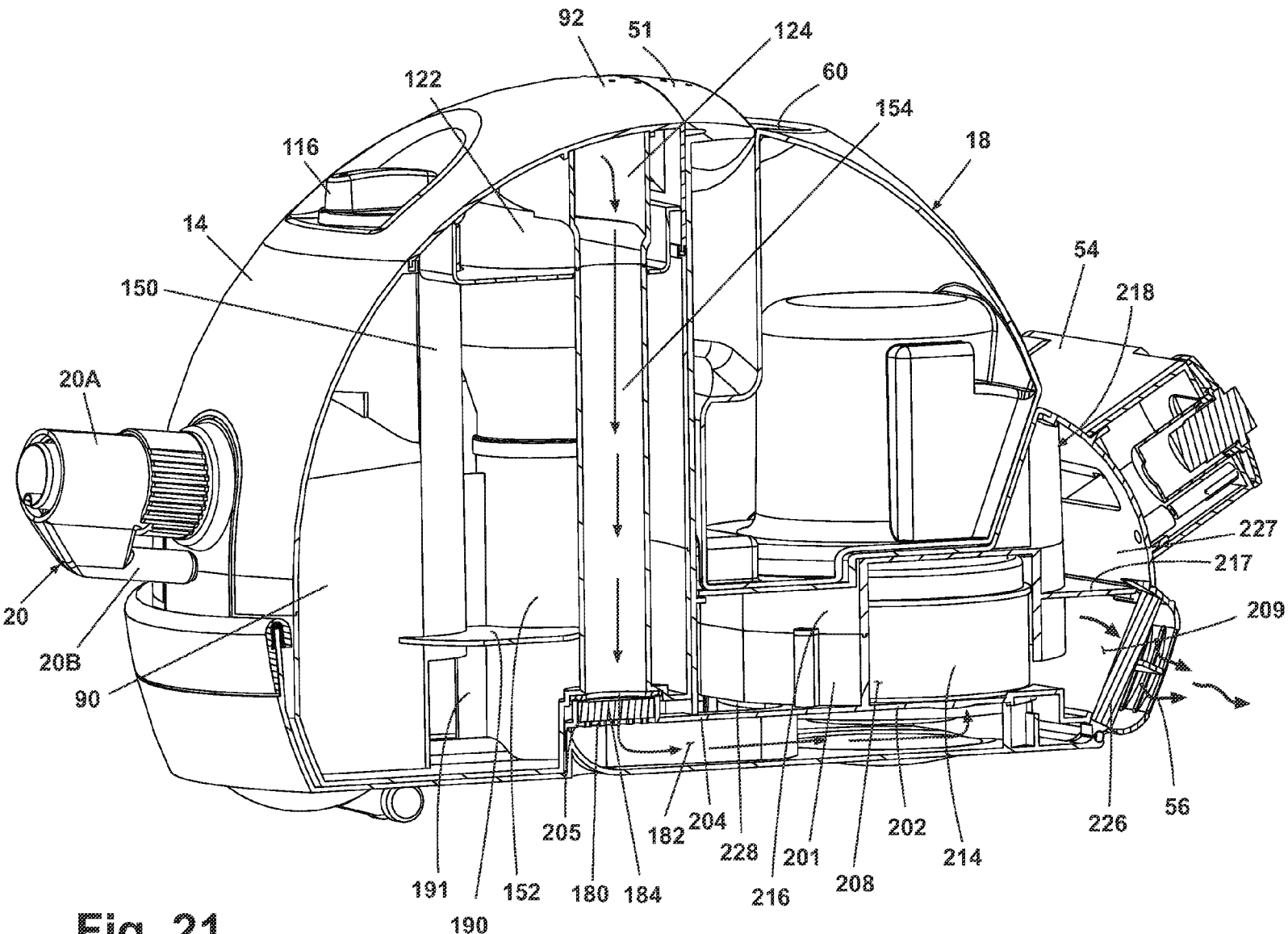
FIG. 21 is a sectional view taken along line 11-11 of FIG. 2 showing a second portion of the path of an air path through the vacuum cleaner of FIG. 1 during dry vacuuming.

Referring to FIGS. 20 and 21, when the vacuum cleaner 10 is used in the dry vacuuming mode, the dry vacuuming nozzle 284 is attached to wand 34*a* and the diverter knob 116 is manually turned to the dry cleaning position. Turning the motor on/off switch 55 to the "on" position completes an electrical circuit from facility power, through a power cord, through the motor on/off switch 55 and the resultant current flow causes the motor/fan assembly 210 to rotate, create a working airflow shown by arrows from the fan assembly 214, which lifts dirt from the surface being cleaned through dry vacuuming nozzle 284*a* and hose 16. In the first stage of filtering, the dirt-laden air travels (as indicated by the solid arrows in FIG. 20) through L-shaped conduit 166 that is in fluid communication with first conduit 162. Since the diverter valve 108 is "closed" (i.e. turned so that the sidewall 112 is oriented toward the front of the vacuum cleaner 10), dirt-laden air is diverted into second conduit 164. The dirt-laden air then passes through the water bath at the water bath inlet opening 168 in the second conduit 164. Dirt and debris is captured by the water and moist clean air is drawn up through the water. The moist clean air is then drawn into the cyclone separator 122 through the air inlet conduit 120 where moisture and any entrained dirt is forced against the walls of the cyclone separator 122 by cyclonic airflow therethrough, thus separating the finer dirt particles that were not filtered by the water bath and any moisture from the water bath. The dirt particles and water fall through opening 130 and into the debris stand conduit 152. Clean air exits the cyclone separator 122 up through the air outlet conduit 124 and then through the exhaust stand conduit 154 and air outlet aperture 180. The cyclone separator exhaust air is drawn through the working air conduit 182 to the motor/fan assembly 210. The working air is then exhausted from the motor/fan assembly 210 and exits the vacuum cleaner 10 through a commonly known HEPA filter 226. The tool caddy 282 can be placed on the motor/fan assembly casing 218 so that the user can easily selectively access the accessory tools for specific cleaning needs. After cleaning is complete, the cover 92 is removed and set aside. The recovery tank casing 81 is removed from the base 12 and taken to a suitable location plumbed to accept waste water and debris. The recovery tank casing 81 is inverted to empty both the water and the debris in the debris stand conduit 152 simultaneously.

Dry vacuuming can also be performed with an empty recovery tank 14. The air flow path through the vacuum cleaner 10 is the same, however, the first stage water bath filter is absent and the air is filtered by the screen 94 to remove larger dirt particles, the cyclone separator 122 for finer particles, and finally the optional coarse filter 184 before working air reaches the inlet to the motor/fan assembly 210.

For bare floor cleaning, the vacuum cleaner 10 can be readied either with or without a water bath filtration stage and the bare floor cleaning head 288 is attached to the wand receiving end 34*b* of the wand 34*a*. The wand 34*a* is maneuvered so that the bare floor cleaning head 288 is oriented in the first position with respect to the pivotable connector 330 (FIG. 19) and the dry nozzle assembly 334 engages the floor surface. Airflow path through the vacuum cleaner 10 is as previously described.

Figure 22:
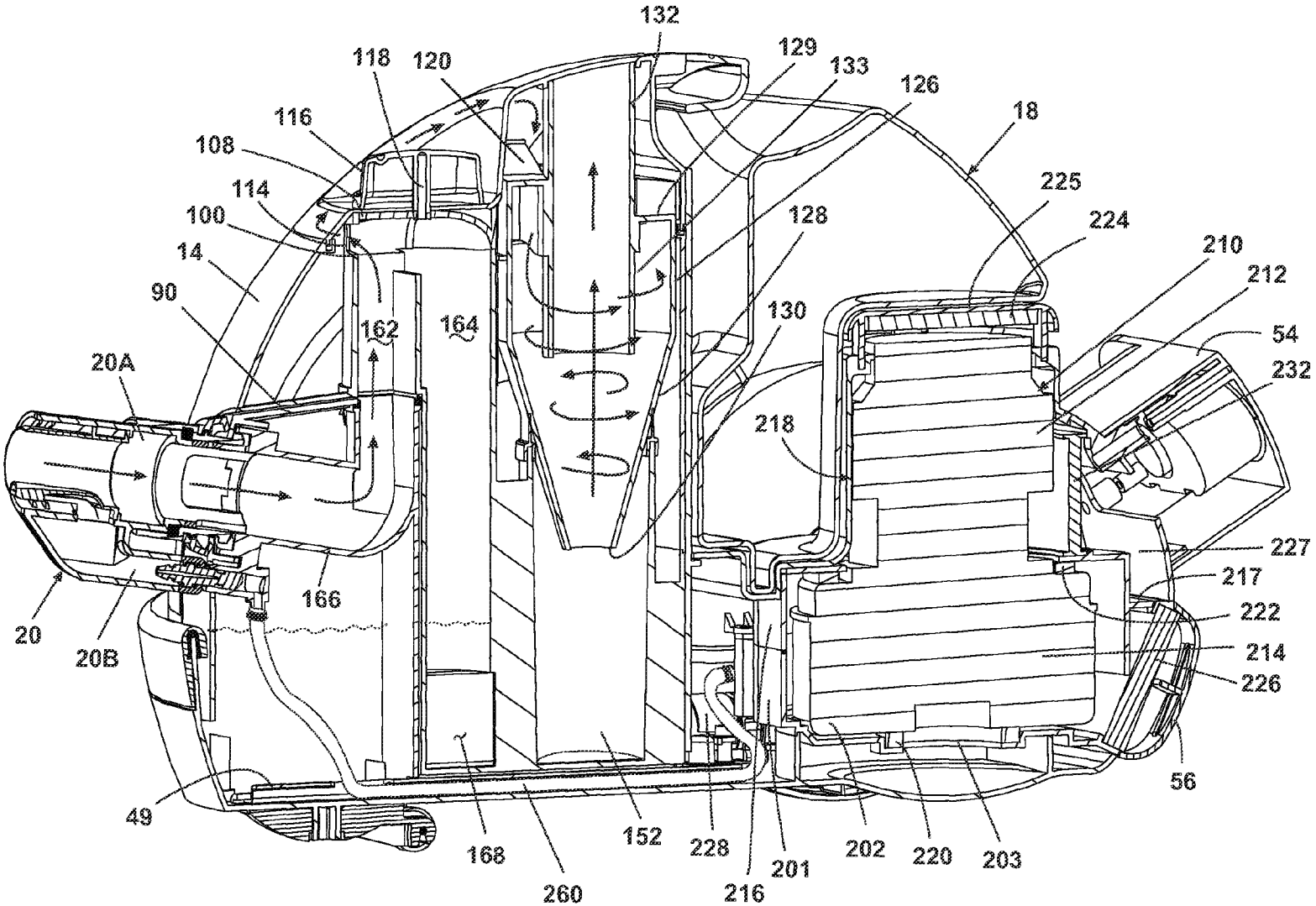
FIG. 22 is a sectional view taken along line 10-10 of FIG. 2 showing a first portion of an air/liquid path through the vacuum cleaner of FIG. 1 during wet vacuuming.

Referring to FIG. 22, wet pickup can be accomplished by maneuvering the wand 34*a* so that the wet nozzle assembly 332 is facing forward as indicated in position 2 with respect to the pivotable connector 330. In the wet pickup mode, the dry nozzle assembly 334 is raised and the wet nozzle assembly 332 engages the floor surface. A diverter valve (not shown) opens an air path to the wet nozzle assembly 332 and blocks an air path to the dry nozzle 326. The clean solution tank 18 is filled with cleaning solution and secured on the motor/fan assembly casing 218. The heater 260 may be turned on at any time during wet cleaning to heat or reheat the cleaning solution. The diverter knob 116 is turned to the wet vacuuming or "open" position. Clean solution is distributed to the floor by depressing the trigger 35. The user then scrubs the floor surface with an agitator on a bottom surface of the bare floor cleaning head 288 to distribute the cleaning solution to a wider area and loosen dirt particles thereon. To pick up the dirty cleaning solution, the vacuum cleaner 10 is turned "on" and a working air/liquid flow is created as previously described, wherein the working airflow is shown with solid arrows. Since the diverter valve 108 is "open" (i.e. turned so that the aperture 114 is oriented toward the front of the vacuum cleaner 10), the working air is forced against the inner front wall of the recovery tank 14 which causes the liquid to separate from the air. The relatively dry air exits through apertures 100 and 114 and enters the cyclone assembly 96 through the inlet conduit 120 and follows the same working air path as previously described (FIGS. 21 and 22).

Carpet cleaning is performed in a similar manner. The carpeted floor surface is first dry vacuumed as described above using the dry vacuuming nozzle 284. The dry vacuuming nozzle 284 is then removed and the wet extraction nozzle 286 is attached to the wand 34*a*. The clean solution tank 18 is filled with cleaning solution and placed on top of the motor cover 218. The user depresses the trigger 35 to distribute cleaning solution onto the carpeted surface to be cleaned. Working air/liquid flow through the vacuum cleaner is as previously described.

Figure 23:
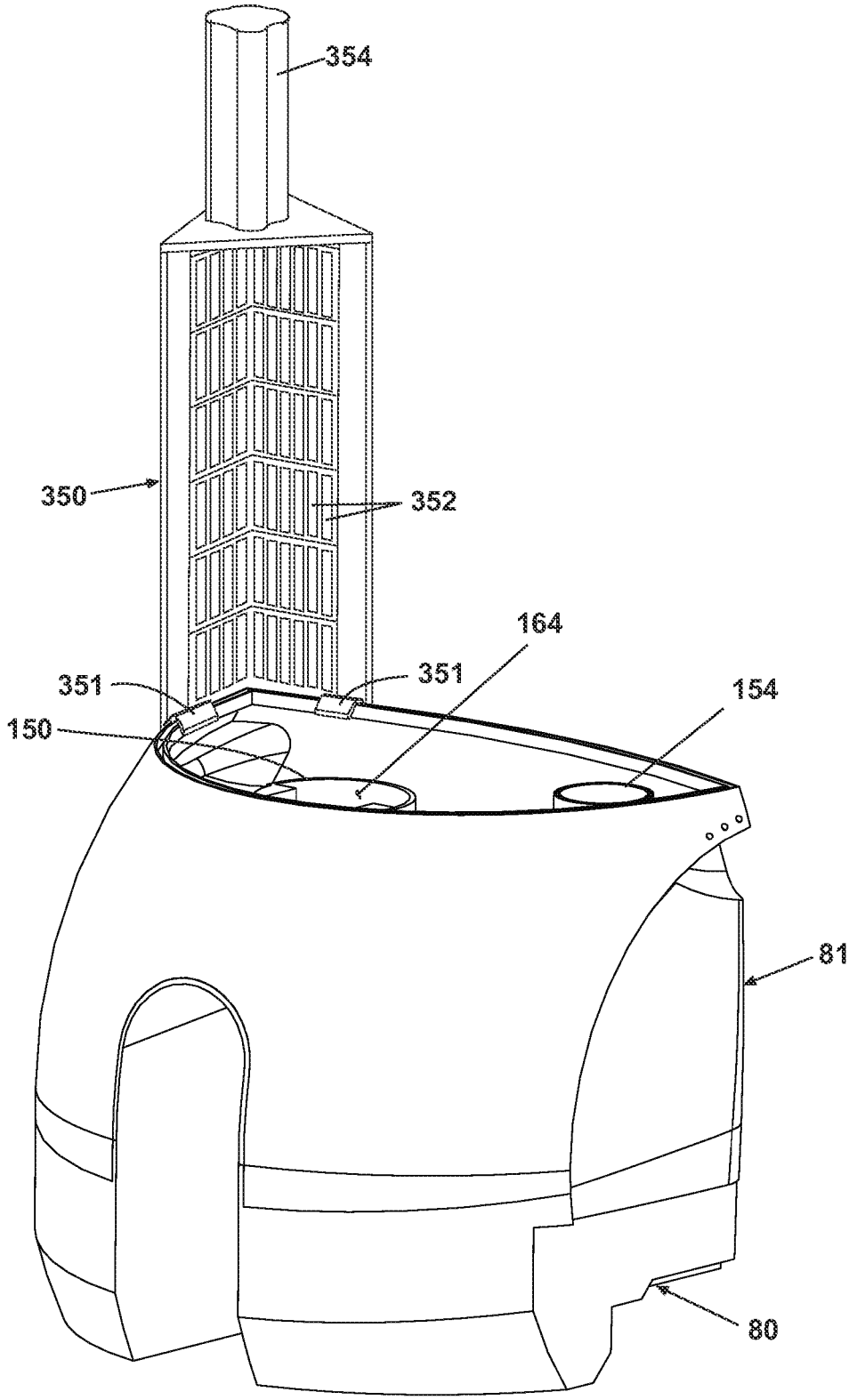
FIG. 23 is a top quarter perspective view of the recovery tank of FIG. 1 with a strainer attachment and a cover removed.

When carpet extraction cleaning is complete, the recovery tank 14 is removed from the base 12 and the dirty water is disposed of in a suitable manner. A handle (not shown) may be attached to the recovery tank 14 to facilitate the process of disposing of the dirty water. Referring now to FIG. 23, some of the larger debris captured during the cleaning process can clog the plumbing system used for disposal, therefore an optional strainer 350 can be affixed to the side wall of the recovery tank 14 by clips 351. The strainer 350 has a grid portion 352 that allows liquid and some smaller dirt particles to pass through the openings in the grid 352 and a handle 354 that can be gripped by a user when emptying the contents of the strainer 350. The strainer 350 can optionally be carried on the tool caddy 282. The dirty water in the recovery tank 14 can be poured through the strainer 350 to manually separate out the larger solid debris to prevent plumbing clogs. The debris captured in the strainer 350 can then easily be disposed in a solid waste receptacle such as a trash bin.

While the invention has been specifically described in connection with certain specific embodiments thereof, it is to be understood that this is by way of illustration and not of limitation, and the scope of the appended claims should be construed as broadly as the prior art will permit. Reasonable variation and modification are possible within the foregoing disclosure and drawings without departing from the spirit of the invention.

The invention claimed is:

1. A combination wet-dry vacuum cleaner comprising:

a recovery tank adapted for wet and dry cleaning and comprising:

a recovery chamber having an inlet opening adapted to be connected to a suction nozzle and having an upper portion and a lower portion, wherein the lower portion is configured to form a water bath receptacle;

an air-liquid separator within the recovery chamber for separating air from liquid in an air-liquid mixture from the suction nozzle; and a conduit within the recovery chamber and having a first end connected to the inlet opening and a second end forming a discharge opening that is positioned in the lower portion of the recovery chamber;

a cyclone separator having an outlet and an inlet;

a first fluid path between the conduit discharge opening and the cyclone separator inlet;

a second fluid path between the air-liquid separator and the cyclone separator inlet; and a diverter valve having an outlet opening and mounted within the conduit between the first and second ends thereof for movement between a first position in which the diverter valve outlet opening is in fluid communication with the second fluid path and a second position in which the diverter valve outlet opening is closed to block fluid communication with the second fluid path; and a suction source that is connected to the cyclone separator outlet, thereby creating a working air path to draw dry, dirt-laden air and liquid-laden air from the recovery chamber inlet opening selectively through either the discharge opening or through the air liquid separator, and through the cyclone separator;

wherein dirt can be separated from dry, dirt-laden air in at least one of the lower portion of the recovery chamber that may contain a water bath and the cyclone separator, and liquid can be separated from liquid-laden air by at least one of the air-liquid separator and the cyclone separator.

2. The combination wet-dry vacuum cleaner according to claim 1 and further comprising a water bath in the lower portion of the recovery chamber.

3. The combination wet-dry vacuum cleaner according to claim 2 wherein the upper portion is selectively removable from the lower portion, and the upper and lower portions are separated by seals.

4. The combination wet-dry vacuum cleaner according to claim 1 wherein the upper portion is selectively removable from the lower portion, and the upper and lower portions are separated by seals.

5. The combination wet-dry vacuum cleaner according to claim 1 wherein the recovery chamber comprises a single recovery chamber provided in the recovery tank.

6. The combination wet-dry vacuum cleaner according to claim 1 wherein the diverter valve comprises a rotatable knob provided on an exterior of the recovery tank.

7. The combination wet-dry vacuum cleaner according to claim 1 further comprising a debris collector in communication with the cyclone separator outlet, wherein the debris collector is separate from the lower portion of the recovery chamber.

8. A combination wet-dry vacuum cleaner comprising:

a recovery tank adapted for both wet and dry cleaning and comprising:

a recovery chamber having an inlet opening adapted to be connected to a suction nozzle and having an upper portion and a lower portion, wherein the lower portion is configured to form a water bath receptacle;

a first air-liquid separator within the recovery chamber for separating air from liquid when an air-liquid mixture enters the recovery tank through the inlet opening;

a second air-liquid separator that is fluidly connected to the recovery chamber for removing liquid from air before it passes from the recovery tank; and a conduit within the recovery chamber and having a first end connected to the inlet opening and a second end forming a discharge opening that is positioned in the lower portion of the recovery chamber; and a first fluid path between the conduit discharge opening and the second air-liquid separator;

a second fluid path between the first air-liquid separator and the second air-liquid separator;

a diverter valve having an outlet opening and mounted within the conduit between the first and second ends thereof for movement between a first position in which the outlet opening is in fluid communication with the second fluid path and a second position in which the outlet opening is closed to block fluid communication with the second fluid path; and a suction source that is connected to the inlet opening through the recovery tank and the second air-liquid separator to draw dry dirt-laden air and liquid-laden air from the inlet opening selectively through either the discharge opening or through the first air-liquid separator, and through the second air-liquid separator;

wherein dirt can be separated from dry dirt-laden air in a water bath selectively provided in the lower portion of the recovery chamber and the second air-liquid separator for dry cleaning, and liquid can be separated from liquid-laden air by at least one of the first air-liquid separator and the second air-liquid separator for wet cleaning.

9. The combination wet-dry vacuum cleaner according to claim 8 and further comprising a water bath in the lower portion of the recovery chamber.

10. The combination wet-dry vacuum cleaner according to claim 8 wherein the upper and lower portions are separated by seals.

11. The combination wet-dry vacuum cleaner according to claim 8 wherein the recovery chamber comprises a single recovery chamber provided in the recovery tank.

12. The combination wet-dry vacuum cleaner according to claim 8 wherein the second air-liquid separator comprises a cyclone separator.

13. The combination wet-dry vacuum cleaner according to claim 8 wherein the diverter valve comprises a rotatable knob provided on an exterior of the recovery tank.

14. The combination wet-dry vacuum cleaner according to claim 8 further comprising a debris collector in communication with the second air-liquid separator, wherein the debris collector is separate from the lower portion of the recovery chamber.

* * * * *